US009312039B2

(12) United States Patent
Lidestri

(10) Patent No.: US 9,312,039 B2
(45) Date of Patent: Apr. 12, 2016

(54) CONFOCAL DOUBLE CRYSTAL MONOCHROMATOR

(75) Inventor: Joseph P Lidestri, New York, NY (US)

(73) Assignee: The Trustees of Columbia University in the City of New York, New York City, NY (US)

( * ) Notice: Subject to any disclaimer, the term of this patent is extended or adjusted under 35 U.S.C. 154(b) by 391 days.

(21) Appl. No.: 13/512,210

(22) PCT Filed: Nov. 24, 2010

(86) PCT No.: PCT/US2010/058084

§ 371 (c)(1),
(2), (4) Date: May 25, 2012

(87) PCT Pub. No.: WO2011/066447

PCT Pub. Date: Jun. 3, 2011

(65) Prior Publication Data

US 2012/0281813 A1 Nov. 8, 2012

Related U.S. Application Data

(60) Provisional application No. 61/264,377, filed on Nov. 25, 2009.

(51) Int. Cl.
*G21K 1/06* (2006.01)

(52) U.S. Cl.
CPC ..... *G21K 1/06* (2013.01); *G21K 2201/062* (2013.01); *G21K 2201/064* (2013.01)

(58) Field of Classification Search
CPC ..... G21K 1/06; G21K 2201/062; G21K 2201/064
See application file for complete search history.

(56) References Cited

U.S. PATENT DOCUMENTS

| | | | | |
|---|---|---|---|---|
| 2,543,830 | A | 4/1950 | Hansen | |
| 4,432,370 | A | 2/1984 | Hughes et al. | |
| 5,157,702 | A | 10/1992 | Middleton et al. | |
| 5,524,040 | A | 6/1996 | Alp et al. | |
| 2004/0028180 | A1* | 2/2004 | Kucharczyk | G01N 23/20 378/70 |
| 2006/0056590 | A1* | 3/2006 | Nikulin | G01N 23/083 378/71 |
| 2006/0239405 | A1 | 10/2006 | Verman et al. | |
| 2007/0291896 | A1 | 12/2007 | Parham et al. | |
| 2008/0279332 | A1 | 11/2008 | Rieutord | |

FOREIGN PATENT DOCUMENTS

DE 20001036305 3/2002

OTHER PUBLICATIONS

Beaumont et al., "Multiple Bragg reflection monochromators for synchrotron × radiation", Journal of Physics E: Scientific Instruments, vol. 7, No. 10, (Oct. 1974), pp. 823-829.*
USISA, "International Search Report for PCT/US2010/058084", Feb. 10, 2011, pp. 1-2.
USISA, "International Search Report/Written Opinion for PCT/US2010/058084", Feb. 11, 2011, pp. 1-7.

* cited by examiner

*Primary Examiner* — Glen Kao
(74) *Attorney, Agent, or Firm* — Beusse Wolter Sanks & Maire, PLLC; Eugene J. Molinelli

(57) ABSTRACT

A monochromator is adapted to select at least one band of wavelengths from diverging incident radiation. The apparatus includes a first crystal and a second crystal. A band of emitted wavelengths of the first crystal is adapted to the at least one band of wavelengths. A surface curvature of the first crystal is adapted to focus emitted radiation in a first plane. A band of emitted wavelengths of the second crystal also is adapted to the at least one band of wavelengths. Parallel faces of a lattice structure of the second crystal are oriented at a first predetermined angle from a surface of the second crystal. In another embodiment, an apparatus is adapted to select at least one band of wavelengths from diverging incident synchrotron radiation in a given range of wavelengths with an energy resolution finer than about five parts in 10000 and optical efficiency greater than about 50 percent.

12 Claims, 16 Drawing Sheets

CONFOCAL DOUBLE CRYSTAL MONOCHROMATOR

CROSS-REFERENCE TO RELATED APPLICATIONS

This application claims benefit of Provisional Appln. 61/264,377, filed Nov. 25, 2009, the entire contents of which are hereby incorporated by reference as if fully set forth herein, under 35 U.S.C. §119(e).

BACKGROUND OF THE INVENTION

Electromagnetic (EM) waves from charged particles at relativistic speeds accelerating in a magnetic field, e.g., to follow a curved path, are called synchrotron radiation. Relativistic time contraction bumps the EM frequency observed in the lab from the frequency corresponding to energies of Giga electron Volts (GeV, 1 GeV=$10^9$ electron Volts) for electrons, into the X-ray range of kilo electron Volts (keV, 1 keV=$10^3$ electron Volts). Another effect of relativity is that the radiation pattern is distorted from an isotropic dipole pattern expected from non-relativistic theory into an extremely forward-pointing cone of radiation. This makes artificial synchrotron radiation the brightest known source of X-rays. The planar acceleration geometry of a synchrotron makes the radiation linearly polarized when observed in the orbital plane, and circularly polarized when observed at a small angle to that plane.

Since the discovery of synchrotron radiation, analytic techniques have been continually developed to exploit its unique properties as a source of X-rays. Undulators and wigglers are insertion devices which are inserted into a straight section of a synchrotron or a storage ring specifically to generate synchrotron radiation with particular characteristics. Many state-of-the-art methods pursue the advantages of high flux and polarization of synchrotron radiation.

It is noted that many methods would otherwise be impossible without good energy resolution—the ability to select a narrow band of EM frequencies (or corresponding EM wavelengths) from the synchrotron radiation. As is well known, the quantized energy (photon) of an EM beam is proportion to its EM frequency. One such technique that relies on good energy resolution is multi-wavelength anomalous diffraction (MAD), which takes advantage of differences in anomalous signals at carefully selected x-ray wavelengths to determine the phases of x-rays diffracted by protein crystals and thus to determine the structure of those crystals. A device that transmits a mechanically selectable narrow band of wavelengths of EM radiation chosen from a wider range of EM wavelengths available at the input is called a monochromator.

SUMMARY OF THE INVENTION

Therefore, there is a need for selecting a narrow band of electromagnetic wavelengths from a diverging beam of synchrotron radiation.

In a first set of embodiments, an apparatus is adapted to select at least one band of wavelengths from diverging incident synchrotron radiation in a given range of wavelengths with an energy resolution finer than about five parts in 10000 and optical efficiency greater than about 50 percent.

In another set of embodiments, an apparatus is adapted to select at least one band of wavelengths from diverging incident radiation in a given range of wavelengths. The apparatus includes a first crystal and a second crystal. A band of emitted wavelengths of the first crystal is adapted to the at least one band of wavelengths. A surface curvature of the first crystal is adapted to focus emitted radiation in a first plane. A band of emitted wavelengths of the second crystal also is adapted to the at least one band of wavelengths. Parallel faces of a lattice structure of the second crystal are oriented at a first predetermined angle from a surface of the second crystal.

In another set of embodiments, an apparatus adapted to select at least one band of wavelengths from diverging incident radiation in a given range of wavelengths, includes a first crystal and a second crystal. A band of emitted wavelengths of the first crystal is adapted to the at least one band of wavelengths. Parallel faces of a lattice structure of the first crystal are oriented at a first predetermined angle from a surface of the first crystal. A band of emitted wavelengths of the second crystal is adapted to the at least one band of wavelengths. Parallel faces of a lattice structure of the second crystal are oriented at a second predetermined angle from a surface of the second crystal.

Still other aspects, features, and advantages of the invention are readily apparent from the following detailed description, simply by illustrating a number of particular embodiments and implementations, including the best mode contemplated for carrying out the invention. The invention is also capable of other and different embodiments, and its several details can be modified in various obvious respects, all without departing from the spirit and scope of the invention. Accordingly, the drawings and description are to be regarded as illustrative in nature, and not as restrictive.

BRIEF DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION

An apparatus is described for selecting a narrow band of particle energies from a diverging beam of radiation. In the following description, for the purposes of explanation, numerous specific details are set forth in order to provide a thorough understanding of the present invention. It will be apparent, however, to one skilled in the art that the present invention may be practiced without these specific details. In other instances, well-known structures and devices are shown in block diagram form in order to avoid unnecessarily obscuring the present invention.

As used herein radiation refers to propagating particles or waves, and a beam refers to particles or waves propagating in a particular direction with finite width and less than some maximum divergence, where divergence refers to width increase with distance traveled. A negative divergence is called convergence and is often the result of focusing. A modifier indicates what particles are propagating in a beam, thus an electron beam refers to electrons propagating, and an electromagnetic beam refers to photons propagating. Photons are quanta of electromagnetic energy that propagate like waves at the speed of light (c); and, for a particular frequency f, a photon has associated a corresponding particular photon energy value E, given by $E=hf$, where h is Planck's constant. A corresponding wavelength $\lambda$ is given by the speed of light divided by the frequency, i.e., $\lambda=c/f$. As used herein, a beam without a modifier refers to an electromagnetic beam, unless otherwise clear from the context. To avoid confusion, particle beams will often be referred to as particle streams. Similarly, a frequency and wavelength can be associated with particles that possess a certain energy and travel at a certain speed.

Some embodiments of the invention are described below in the context of accepting incident diverging synchrotron radiation with an incident band of X-ray wavelengths and putting out a focused beam with a narrow band of X-ray wavelengths compared to the incident band, and, therefore, better energy resolution. However, the invention is not limited to this context. In other embodiments the incident radiation is from any small phase plane source, including EM radiation in another overlapping or non-overlapping EM wavelength band in diverging or converging beams and the output is radiation with at least a narrower band of energy values, e.g., finer energy resolution.

Figure 1A:
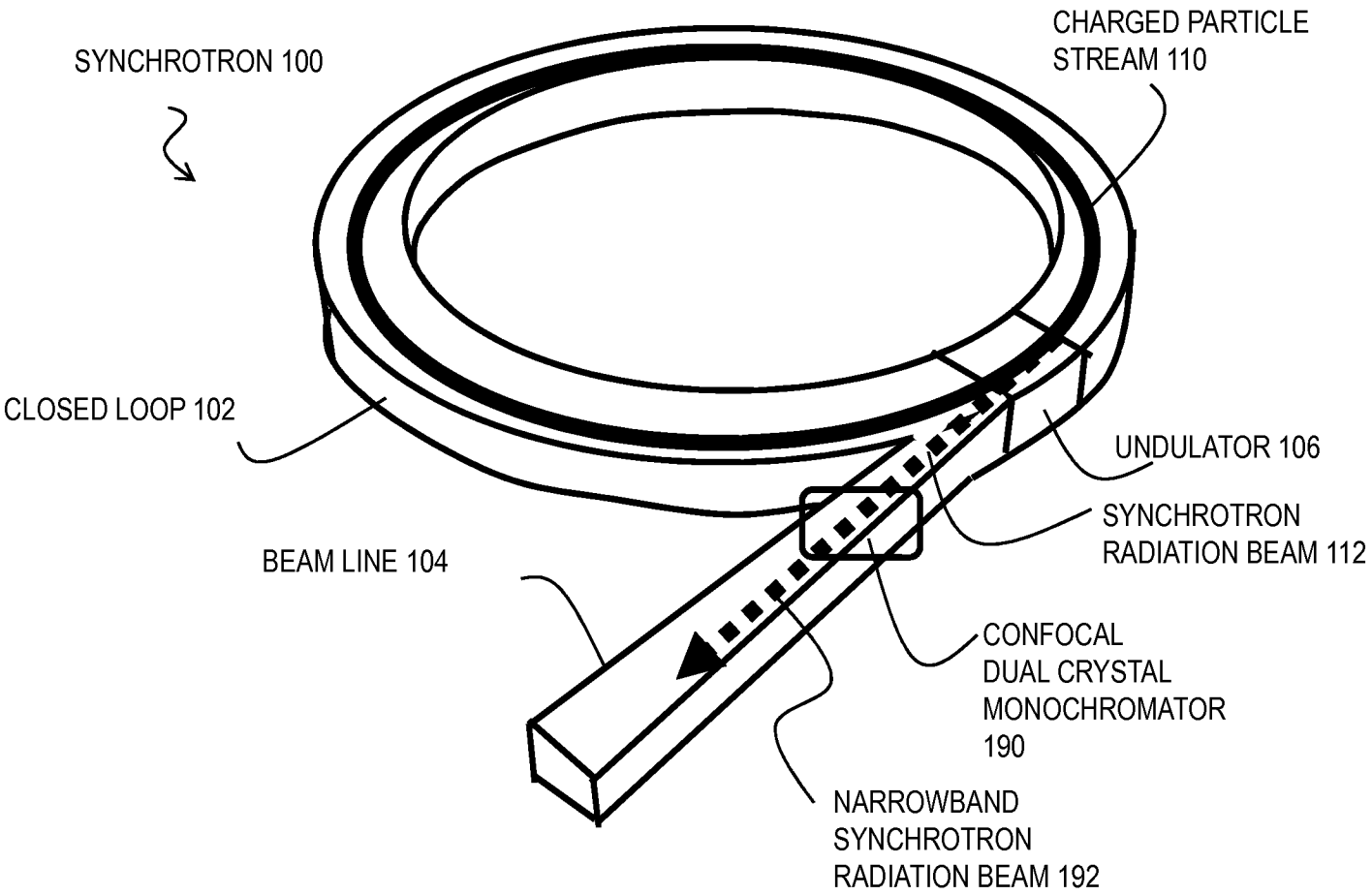
FIG. 1A is a block diagram that illustrates an example synchrotron system with a beam line for synchrotron radiation, according to an embodiment.

FIG. 1A is a block diagram that illustrates an example synchrotron system 100 with a beam line 104 for synchrotron radiation, according to an embodiment. The synchrotron comprises a closed loop 102 in which a charged particle stream 110 is accelerated to relativistic speeds (near c) by synchronized changes to applied electric and magnetic fields. At one or more points along the loop a portion of the particle steam can be diverted along a linear facility called a beam line 104 substantively tangent to the loop 102. The particle stream is used along the beam line 104. Although the synchrotron of system 100 is depicted as a circular loop with a single beam line, in other embodiments the synchrotrons has regularly or irregularly alternating straight and curved sections with one or more beam lines tangent to different portions of the synchrotron.

In the illustrated embodiment, the loop 102 includes an insertion device 106 to accelerate the relativistic charge particles to emit a synchrotron radiation beam 112 directed along beam line 104. A monochromator 190 is included within beam line 104 to produce a narrowband synchrotron radiation beam 192. According to an illustrated embodiment, the synchrotron system 100 includes a confocal two crystal monochromator (CDCM) 190 with superior properties in beam line 104 to produce a focused narrowband synchrotron radiation beam 192.

Figure 1B:
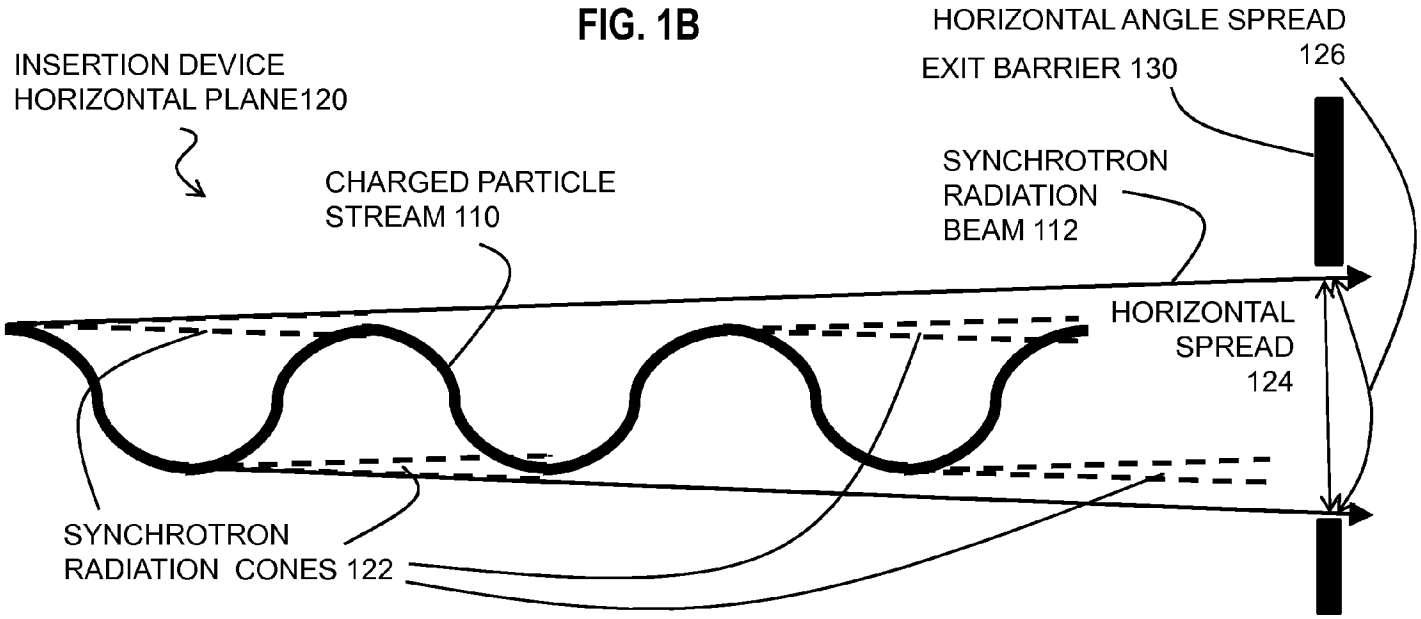
FIG. 1B is a block diagram that illustrates an example horizontal plane in an insertion device in the system of FIG. 1A, according to an embodiment.

To illustrate how the CDCM 190 is superior to previous monochromators, it is helpful to consider the properties of the synchrotron radiation output by the insertion device 106. FIG. 1B is a block diagram that illustrates an example horizontal plane 120 in an insertion device 106 in the system of FIG. 1A, according to an embodiment. FIG. 1B is a plan view. The horizontal plane is also called the dispersion plane because the charged particle stream undergoes direction changes of velocity (dispersion) in this plane as it circumnavigates the synchrotron. The relativistic charged particle stream 110, e.g., a relativistic electron beam, is subjected to a first magnetic field directed in the direction perpendicular to the plane depicted in FIG. 1B, which causes the particles to follow a curved path in one direction, e.g., clockwise. Then the relativistic charged particle stream is subjected to a second magnetic field directed in the opposite horizontal direction perpendicular to the plane depicted in FIG. 1B, which causes the particles to follow a curved path in the opposite direction, e.g., counterclockwise. The particle stream 110 is subjected to several alternating magnetic fields. At each turn, the stream 110 emits a cone-shaped beam of synchrotron radiation 122 with small divergence. The cones coalesce to form a combined synchrotron radiation beam 112, with a horizontal spread 124 and horizontal angle spread 126 at an exit barrier 130 of the insertion device.

The distribution of photons in the synchrotron radiation beam 112 is not uniform in space or wavelength. The spatial distribution of photons horizontally within the horizontal spread 124 is represented by the standard deviation of the horizontal component about the mean horizontal position value and designated $\sigma h$. Similarly, the horizontal angle distribution of photons within the horizontal angle spread 126 is represented by the standard deviation of the horizontal angle component about the mean horizontal direction value and designated $\sigma' h$.

Figure 1C:
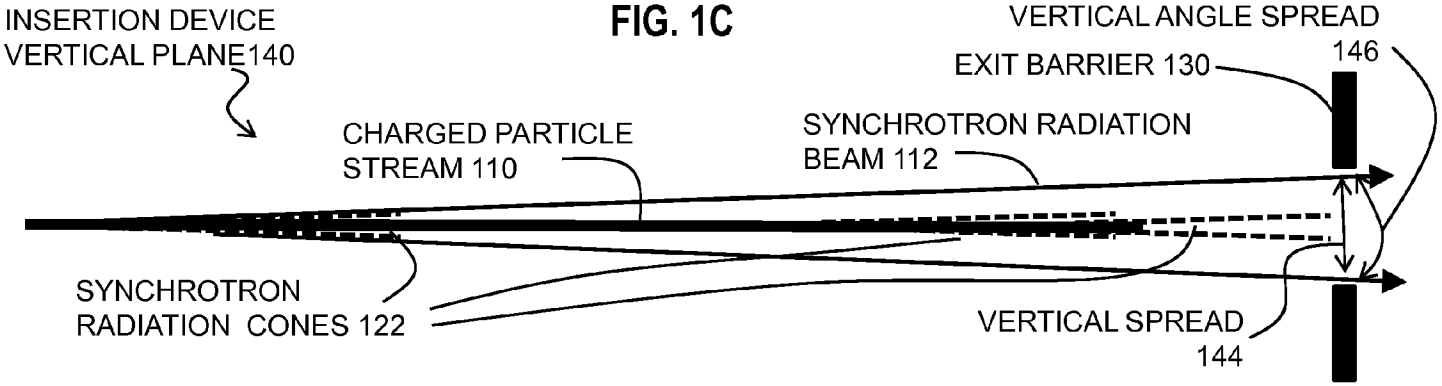
FIG. 1C is a block diagram that illustrates an example vertical plane in an insertion device in the system of FIG. 1A, according to an embodiment.

FIG. 1C is a block diagram that illustrates an example vertical plane 140 in an insertion device 106 in the system of FIG. 1A, according to an embodiment. FIG. 1C is an elevation view. At each horizontal turn, the stream 110 emits a cone-shaped beam of synchrotron radiation 122 with small divergence. The cones coalesce to form a combined synchrotron radiation beam 112, with a vertical spread 144 and vertical angle spread 146 at an exit barrier 130 of the insertion device.

The distribution of photons in the synchrotron radiation beam 112 is not uniform in space or wavelength in the vertical plane either. The spatial distribution of photons vertically within the vertical spread 144 is represented by the standard deviation of the vertical component about the mean vertical position value, and designated $\sigma v$. Similarly, the vertical angle distribution of photons within the vertical angle spread 146 is represented by the standard deviation of the vertical angle component about the mean vertical direction value, and designated $\sigma' v$.

It is less complicated and therefore most common that the smallest phase plane be utilized in conjunction with a monochromator to achieve good energy resolution, e.g., to select waves of limited wavelength range. Waves which undergo constructive interference due to Bragg scattering from a crystal lattice are used to limit the wavelength range output by the monochromator relative to the wavelength range of the incident synchrotron radiation. A crystal is used because the lattice spacing is on the order of X-ray wavelengths, which are too short for discriminating scattering by diffraction gratings used at visible wavelengths. Either matching or limiting the angular acceptance of the monochromator to the Darwin width of the monochromator crystal can achieve optimum energy resolution. The Darwin width is the angular spread detected for a single wavelength that impinges on the crystal due to the finite size of scatterers at lattice points in the crystal and variations in polarization at a particular wavelength; the Darwin width leads to a band of wavelengths that appears at a particular Bragg scattering angle. The most common monochromator geometry for synchrotron radiation beam lines, such as beam line 104, is the Double Crystal Monochromator (DCM).

Figure 1D:
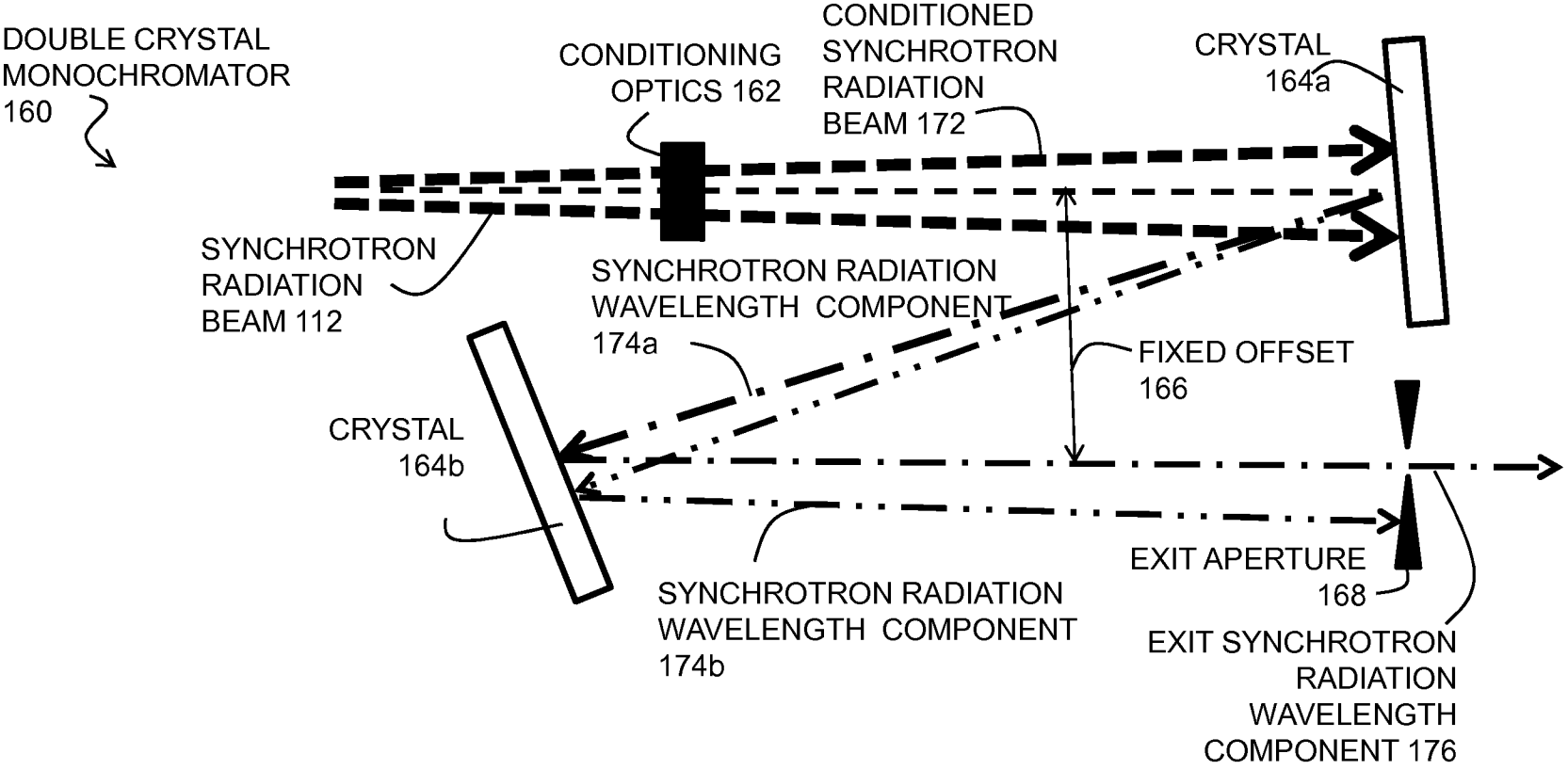
FIG. 1D is a block diagram that illustrates an example double crystal monochromator (DCM)

FIG. 1D is a block diagram that illustrates an example double crystal monochromator (DCM) 160. The view is in the vertical plane in FIG. 1C. The diverging synchrotron radiation beam 112 is subjected to input conditioning optics 162 to reduce the divergence of the beam. For example, in some monochromators, the conditioning optics 162 includes a collimating mirror with a concave face curved to match the divergence of beam 112 to put out a substantively non-diverging and non-converging beam. In some monochromators, the conditioning optics 162 includes an aperture to strip out the outer portion of the beam 112 to pass only X-rays with a smaller divergence angle, e.g., on the order of the Darwin width. The conditioning optics 162 outputs a conditioned synchrotron radiation beam 172 that impinges on a first diffraction crystal 164 which forward scatters different wavelengths at different angles. For example, synchrotron radiation component wavelength 174*a* is emitted at one angle; and a different synchrotron radiation wavelength component 174*b* is emitted at a different angle. Because of the Darwin width, and any remaining divergence in the beam 172, there is a small number of photons of the second wavelength 174*b* at the first angle, and a small number of photons of the first wavelength 174*a* at the different angle.

The second crystal 164*b* is disposed so that at least the beam of the target wavelength emitted from the first crystal 164 impinges on the second crystal 164*b*. The second crystal 164*b* is positioned and rotated relative to the first crystal 164*a* so that the desired wavelength band propagates through exit aperture 168 along a line closely parallel to, and a fixed offset 166 from, the incident radiation (e.g., synchrotron radiation beam 112). The component that passes through the exit aperture 168 is called the exit synchrotron radiation wavelength component 176. An energy scan is achieved by rotating the first crystal relative to the input beam to achieve constructive interference at different wavelengths in the beam that impinges on the second crystal. The geometry is made simple if both crystals have the same scattering angles and attached to the same rotating platform. Thus both crystals are typically made of the same material. Realizing fixed beam offset while scanning energy is highly desirable in high precision instruments, which is why DCM is so popular.

A focusing version of the DCM includes a sagittally bent second crystal, which provides single focusing in the plane orthogonal to the vertical plane. As used herein, the sagittal plane refers to a plane perpendicular to the vertical plane oriented by the first crystal and including lines perpendicular to the receiving surface of the second crystal. The typical DCM has a flat unbent first crystal 164*a* oriented to scatter in the vertical plane. The vertical plane is usually chosen because of its much smaller phase plane (solid angle). In common DCM use, the vertical plane is subjected to reduction of angular acceptance by utilizing limiting slits or a collimating mirror in conditioning optics 162 to improve energy resolution of the DCM.

Figure 2A:
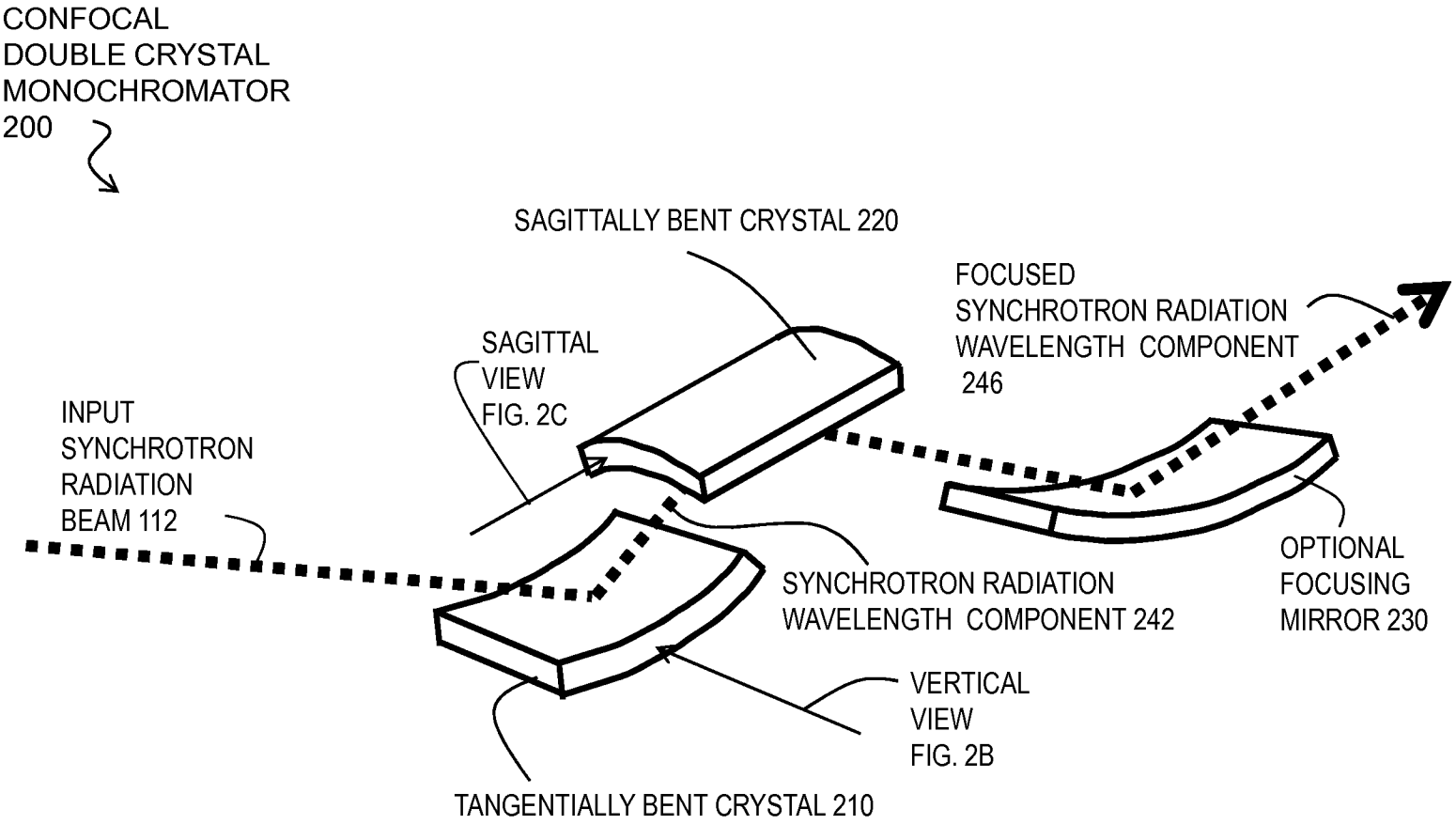
FIG. 2A is a block diagram that illustrates a perspective view of a confocal double crystal monochromator system, according to an embodiment.

In the illustrated embodiments of a new confocal DCM (CDCM), improved energy resolution is achieved with fewer optical components (e.g., no slits or collimating mirror) and without reducing an angle of acceptance. FIG. 2A is a block diagram that illustrates a perspective view of a confocal double crystal monochromator system 200, according to an embodiment. The confocal double crystal monochromator system 200 includes a tangentially bent crystal 210 and a sagittally bent crystal 220. In some embodiments, the system includes a vertical focusing mirror 230. The diverging incident synchrotron radiation beam 112 impinges on the tangentially bent crystal 210 which focuses the beam in the vertical plane while separating wavelengths. The vertical focusing is greatest if the tangential curve is matched to overcome the divergence of the incoming beam, but deviations of about this curvature are used in other embodiments. At least some of the wavelengths emitted from the tangentially bent crystal 210 impinge onto the surface of the sagittally bent crystal 220 which focuses the beam in the sagittal plane and further reduces the power of the wavelengths outside the Darwin width. In various embodiments, any sagittal curvature is used, from no curvature to the elastic limit of the crystal. However, to compensate for the converging rays of a single wavelength introduced by the tangential curve of the first crystal, the second crystal is cut asymmetrically, as described in more detail below.

Thus, the CDCM is an example apparatus adapted to select at least one band of wavelengths (e.g., a narrow band including a target wavelength) from diverging incident radiation (such as the synchrotron radiation) in a given range of wavelengths (e.g., all bright wavelengths in the synchrotron radiation). The apparatus comprises a first crystal 210 and a second crystal 220. A band of emitted wavelengths (e.g., the Bragg scattered components) of the first crystal is adapted to the at least one band of wavelengths (e.g., include the target wavelength). A surface curvature of the first crystal is adapted to focus emitted radiation in a first plane (e.g., the vertical plane). A band of emitted wavelengths of the second crystal (e.g., the Bragg scattered components from the second crystal) is adapted to the at least one band of wavelengths (e.g., include the target wavelength). Parallel faces of a lattice structure of the second crystal are oriented at a first predetermined angle from a surface of the second crystal (e.g., are asymmetrically cut).

In some embodiments, the second crystal is rotatable in concert with the first crystal in order to direct the emitted beam substantively parallel to and offset from the incident beam 112 for any selected wavelength. Thus, the second crystal is adapted to rotate so that radiation emitted by the second crystal is directed in a similar direction and spatially offset from the incident radiation.

In some embodiments, the first crystal 210 is bent tangentially to match the opening angle of the x-ray source in such a way that all rays in the diffracting plane satisfy the Bragg condition, so that the energy resolution can be optimized without passing the incident synchrotron radiation through a slit or reflecting it from a collimating mirror.

Furthermore, at least one of the crystals is an asymmetrically cut crystal (ASC) in which the crystal surface is not parallel to a crystal lattice face. When the crystal lattice faces are at a positive angle relative to the crystal surface, e.g., the crystal lattice face increases depth into the crystal in the forward scattering direction, then the angular spread of the target wavelength about the Bragg diffraction angle is reduced, thus reducing the bleeding of the target wavelength into adjacent angles and increasing the energy resolution (dE/E). A negative angle relative to the crystal surface, e.g., the crystal lattice face decreases depth into the crystal in the forward scattering direction, increases the angular acceptance.

In the illustrated embodiments, a negative asymmetric cut is used in the second crystal so that more of the impinging light at the target wavelength that is converging because of the tangential curvature of the first crystal, are focused, thus improving optical efficiency of the monochromator. Thus, in such embodiments, parallel faces of a lattice structure of the second crystal are oriented at a first predetermined angle from a surface of the second crystal. The maximum asymmetric angle depends on the crystal and is about seven (7) degrees for the Silicon (111) lattice crystals used herein. Smaller angles can be used in various embodiments, as long as some compensation is made for non parallel Bragg target wavelengths scattered by the first crystal are accepted at the second crystal.

As shown in FIG. 2A, the second crystal is also curved sagittally, in at least some embodiments, to provide focusing in the sagittal plane. The curvature is as great as possible to shorten the focus distance to something on the order of 4 or 5 meters downstream from the monochromator. However, the sagittal curvature is often constrained by the elastic limit of the crystal to a radius of curvature of many meters.

In some embodiments, the first crystal is also symmetrically cut to increase energy resolution. As described above, for positive asymmetric cuts, the angular spread of the target wavelength about the Bragg diffraction angle is reduced, thus reducing the bleeding of the target wavelength into adjacent angles and increasing the energy resolution (dE/E). Thus, in some embodiments, parallel faces of a lattice structure of the first crystal are oriented at a second predetermined angle from a surface of the first crystal to increase energy resolution. These asymmetric cut angles vary from the maximum achievable in the crystal material being used to much smaller angles. An advantage of smaller asymmetric cut angles is higher efficiency, as fewer of the photons are lost by the extra absorption experienced by penetrating deeper into the crystal to reach the steeper asymmetric cut angles.

The downstream focal point in the vertical plane is constrained by the asymmetric crystal angles; therefore, in some embodiments, an additional vertical mirror 230 is useful for practical positioning of the vertical focus at a particular distance downstream in the beam line. This grazing incident mirror is also useful for rejection of unwanted high order harmonics diffracted by the crystals. Thus, in some embodiments, the CDCM system includes a mirror with a curved surface adapted to position a vertical focus of radiation emitted from the second crystal in the band of emitted wavelengths of the second crystal. Thus the monochromator system 200 comprises a mirror with a curved surface adapted to reject high order harmonics of at least one of the band of emitted wavelengths of the first crystal or the band of emitted wavelengths of the second crystal.

The next two figures depict different planar views. The vertical plane direction of view of FIG. 2B and sagittal direction of view of FIG. 2C are indicated by arrows so labeled in FIG. 2A.

Figure 2B:
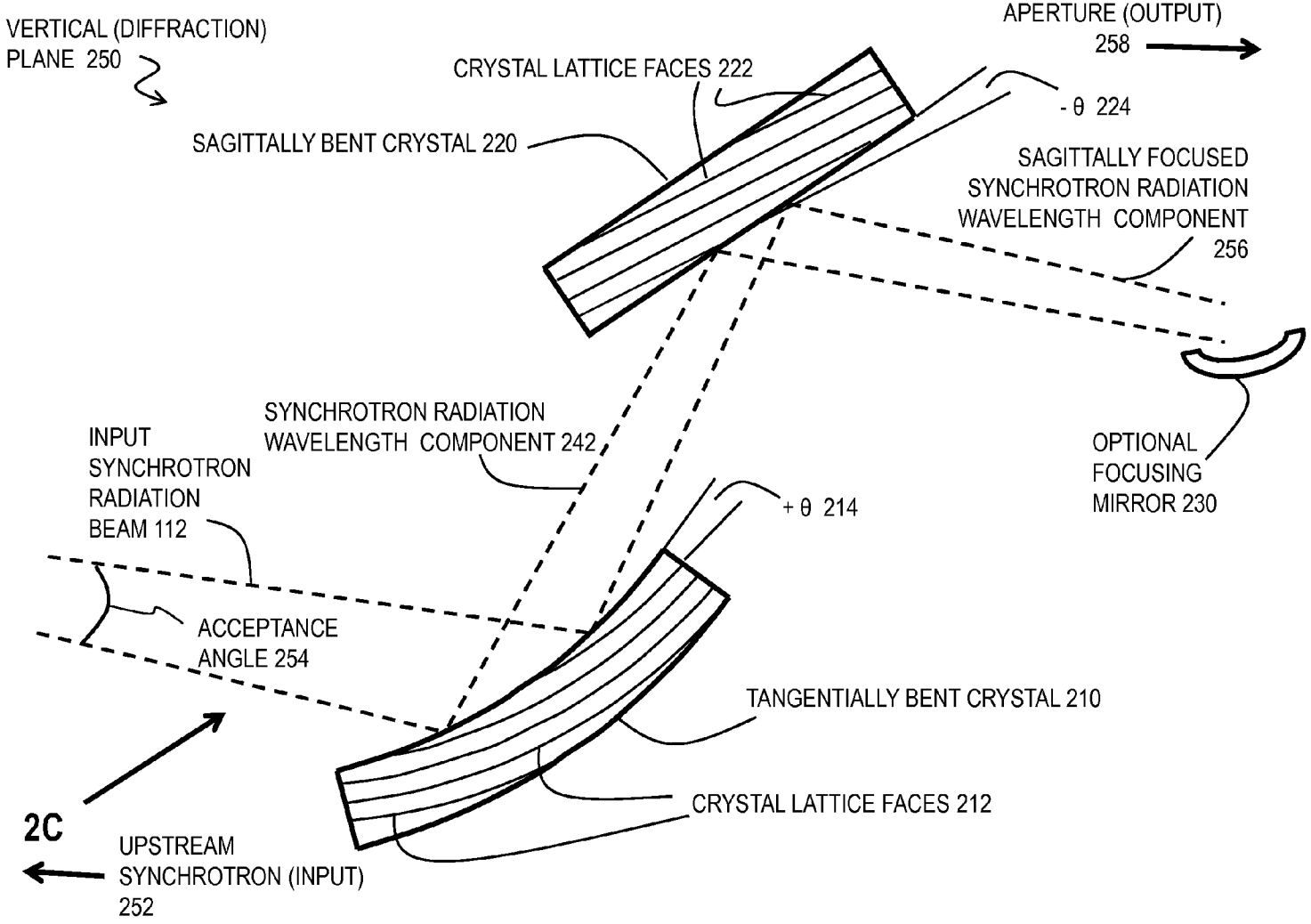
FIG. 2B is a block diagram that illustrates a vertical view of the double crystal monochromator system of FIG. 2A, according to an embodiment.

FIG. 2B is a block diagram that illustrates a vertical plane view 250 of the double crystal monochromator system 100 of FIG. 2A, according to an embodiment. The input synchrotron radiation beam 112 comes from an upstream synchrotron 252 as input. The tangentially bent crystal 210 has an acceptance angle 254 that matches or exceeds the angular spread (σ'v) of the source and emits a synchrotron radiation wavelength component 242 that is vertically focused to a vertically converging beam (the perpendicular component could still be diverging). The emitted synchrotron radiation wavelength component 242 impinges on a surface of the sagittal bent crystal 220 which directs the now parallel but offset and sagittally focused synchrotron radiation wavelength component 256 to the optional focusing mirror 230. Thus, the second crystal 220 is disposed to receive at least the band of emitted wavelengths (component 242) of the first crystal 210.

FIG. 2B also shows the crystal lattice faces 212 and 222, which are not parallel to the surface of the asymmetrically cut crystals 210 and 220, respectfully. The tangentially bent crystal has a positive asymmetric angle θ 214, and the sagittally bent crystal 220 has a negative asymmetric angle −θ 224 of the same size but opposite sign.

Figure 2C:
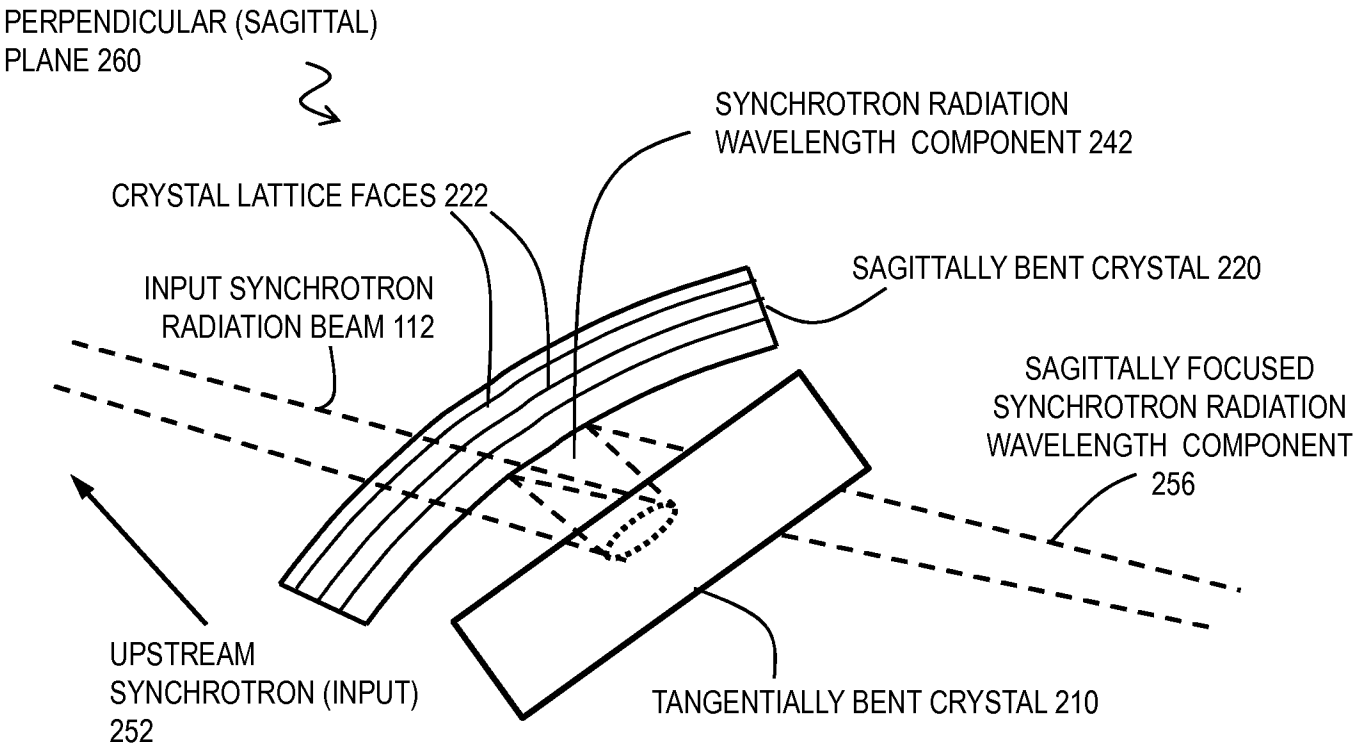
FIG. 2C is a block diagram that illustrates a perpendicular (sagittal) view of the double crystal monochromator of FIG. 2A, according to an embodiment.

FIG. 2C is a block diagram that illustrates a perpendicular (sagittal) plane view 260 of the double crystal monochromator of FIG. 2A, according to an embodiment. The upstream synchrotron input 252, tangentially bent crystal 210, sagittally bent crystal 220, input synchrotron radiation beam 112, synchrotron radiation wavelength component 242, and sagittally focused synchrotron radiation wavelength component 256 are as described above. In this view, the curvature of the sagittally bent crystal 220 is apparent. The dotted oval indicates the illuminated area on the out-of-view surface of the crystal 210.

The example shown in FIG. 2B and FIG. 2C is illustrated with crystals having +7 degree asymmetric cuts between the face and the Bragg planes in the first crystal and opposite −7 degree asymmetric cuts between the face and the Bragg planes in the second crystal. An advantage of such embodiments is that this geometry increases optical efficiency by utilizing an ASC in the second position with its orientation in favor of increasing the acceptance angle facing the first crystal. In various other embodiments, a different angle than 7 degrees is used, and the angles in the two crystal are not of the same size and opposite sign, but, instead, are of different sizes and opposite or same sign. Thus, in some embodiments, the first predetermined angle (of lattice faces to surface of the second crystal) is opposite to the second predetermined angle (of lattice faces to surface of the first crystal). Thus, in some embodiments, the second predetermined angle is opposite to the first predetermined angle; and, some embodiments, the first predetermined angle is about seven degrees.

Figure 2D:
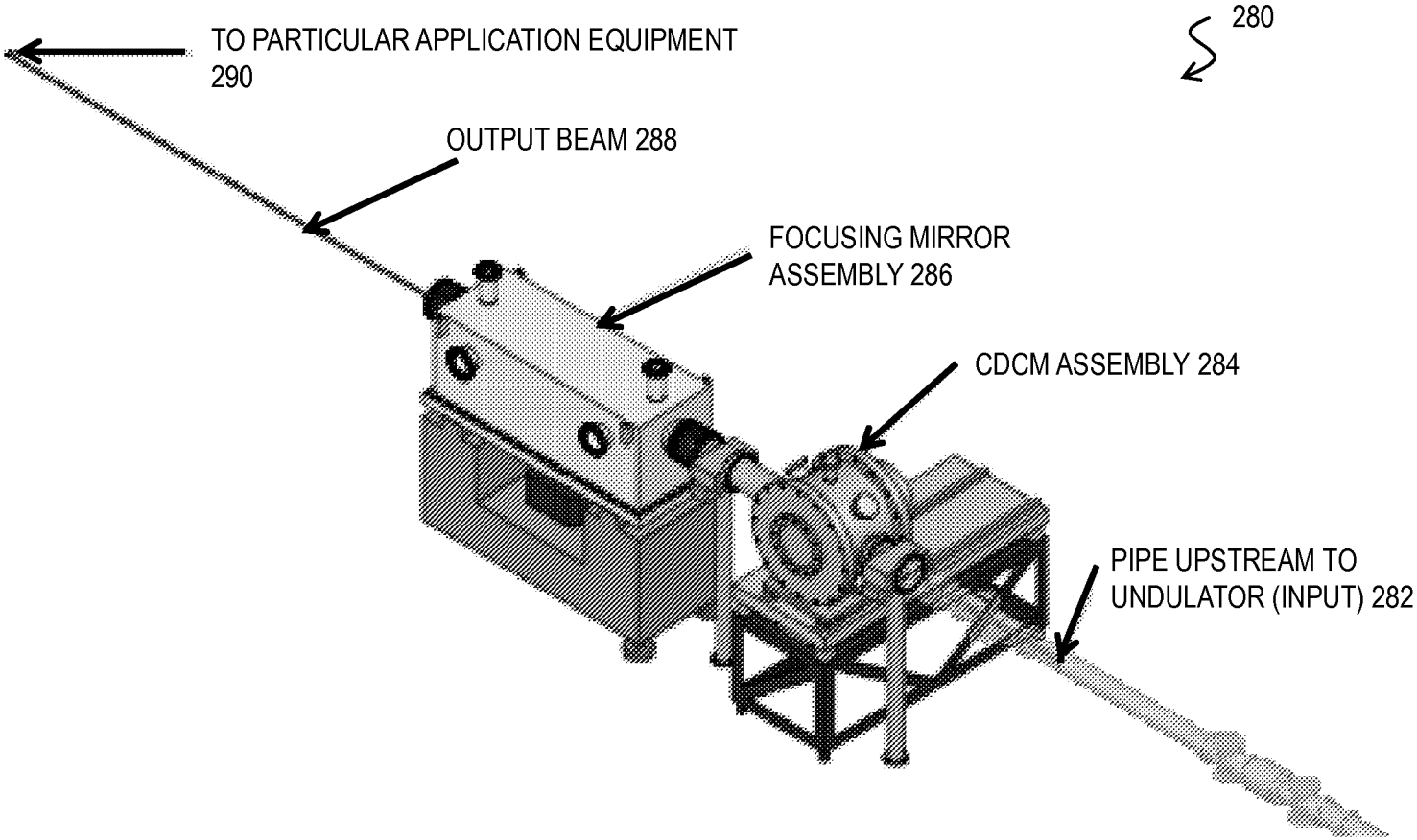
FIG. 2D is a block diagram that illustrates a perspective view of the system of FIG. 2A with vacuum housing in a beam line for synchrotron radiation, according to an embodiment.

FIG. 2D is a block diagram that illustrates a perspective view of the system of FIG. 2A with vacuum housing in a beam line for synchrotron radiation, according to an embodiment.

The pipe upstream to the insertion device input 282 is depicted, as is the CDCM assembly 284 housing the crystals 210 and 220, the focusing mirror assembly 282 housing mirror 230, and the output beam 288 directed toward particular application equipment 290.

Given the Cryogenic Permanent Magnet Undulator (CPMU) at the National Synchrotron Light Source (NSLS) at Brookhaven National Laboratory as an X-ray source, it is found that the electron beam angular divergence dominates the X-ray opening angle of input synchrotron radiation beam 112. The full opening angle of the CPMU in the vertical plane is 60 micro radians (μrad, where 1 μrad=$10^{-6}$ radians), which is 2 times the diffraction limited opening angle of the undulator in this embodiment. When utilizing a flat monochromator crystal, the best achievable energy resolution is limited by this finite opening angle of the X-ray beam. When the opening angle is reduced by slitting to produce a more limited acceptance angle at the monochromator, an overall reduction of flux also results, which is undesirable.

Figure 3:
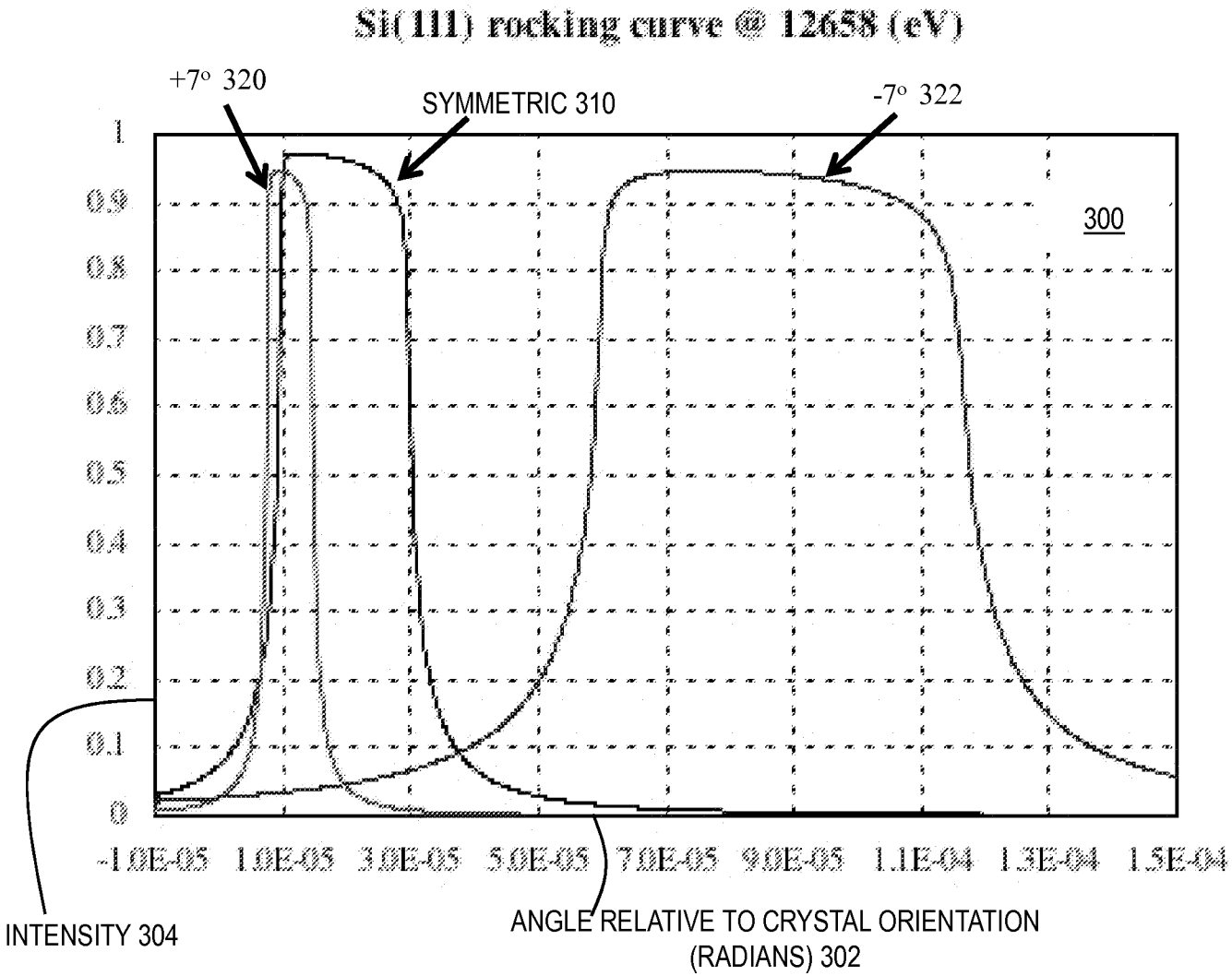
FIG. 3 is a graph that illustrates an example improvement in energy resolution using asymmetric crystals, according to an embodiment.

FIG. 3 is a graph 300 that illustrates an example improvement in energy resolution using asymmetric crystals, according to an embodiment. The horizontal axis 302 is angle relative to crystal surface in radians, where E represents ten raised to the power of the following digits. The vertical axis 304 is emitted intensity in relative units. The rocking curves for an X-ray wavelength corresponding to a photon energy of 12658 electron Volts (eV) impinging on a Silicon crystal with a cubic lattice, designated Si(111), are shown for a symmetric cut crystal 310 and an asymmetric cut crystal with 7 degree angle. The emitted angle is shown for both orientations of the asymmetric cut crystal relative to forward scattering, corresponding to +7 degrees, rocking curve 320, and −7 degrees, rocking curve 322.

As shown in graph 300, the +7 degree asymmetric cut rocking curve 320 narrows the angular spread of the emitted X-rays of the specified wavelength compared to the symmetric cut rocking curve 310. Conversely, the −7 degree asymmetric cut rocking curve 322 widens the angular spread of the emitted X-rays of the specified wavelength compared to the symmetric cut rocking curve 310.

In one illustrated embodiment, the full width of the narrowed rocking curve 320 results in improved energy resolution for the first crystal 210; and the width of the broadened curve 322 is exploited to increased angular acceptance at the second crystal 220. This increased angular acceptance in the second crystal is advantageous because of the mismatch in the diffracting planes caused by tangentially bending the first crystal to the radius of curvature that satisfy the condition of diffraction along the entire length of the crystal.

An advantage of this embodiment of the CDCM geometry is the monochromatic match to the finite angular divergence of the X-ray beam while still allowing the second crystal to be sagittally bent for focusing in the perpendicular plane. Additionally, the first crystal results in vertical focusing; and is advantageously cut asymmetrically to decrease the energy band pass, which results in increased energy resolution. This is accomplished by orienting the asymmetric angle of the first crystal in the opposite direction from the asymmetric angle of the second, which allows the energy band pass of the monochromator to be definable by selection of the asymmetric angle.

Simulated performance of a CDCM according to one embodiment has been determined for use within a proposed beam line 104 for a current synchrotron system (National Synchrotron Light Source, NSLS, at Brookhaven National Laboratory) and a future synchrotron system (NSLSII). The computer simulations use the synchrotron optics code SHADOW ray tracing from the University of Wisconsin. The proposed beam line, called X5, is 40 meters (m) long and fed by a particular undulator, the Cryogenic Permanent Magnet Undulator (CPMU). As stated above, this undulator has a full opening angle in the vertical plane of 60 μrad. Given the long distance (40 m), the length of a vertical grazing mirror into application apparatus at the end of the beam line becomes long due to the finite beam divergence of the source.

The added benefit of vertical focusing in the CDCM tends to control the beam divergence allowing the vertical mirror to be shortened and kept to a minimum. By placing the vertical mirror 230 about 2 m downstream from the monochromator, the length required for 12658 eV X-rays is estimated to be 1 m long. To reduce the dominant horizontal source size, the monochromator is placed 4.5 m from the downstream focus and before the vertical mirror to achieve 8:1 demagnification in the sagittal plane.

The source parameters used in the computer model were computed from the actual electron beam parameters at the NSLS X5 port. The size of the electron beam is given as $2\sigma v$=640 micrometers (μm, also called microns, 1 μm=$10^{-6}$ meters), $2\sigma h$=15.4 μm and the electron beam divergence in terms of angular standard deviations are given as $2\sigma' v$=460 μrad, $2\sigma' h$=52 μrad. The X-ray source parameters from accelerating these electron beams in an undulator are derived from the following parameters for a given CPMU. Assuming a 5 m long undulator with 36 magnetic reversal cycles of 14 millimeter distance per cycle (1 millimeter, mm, =$10^{-3}$ meters), and magnetic field Bremant=1.45 Tesla (T), gap=6.5 mm (K=0.76), n=3rd harmonic, the flux calculated at X-rays of energy 12658 eV is $4.78\times10^{13}$ (photons/second/0.1% bandwidth, BW). This X-ray flux is associated with a total radiant power Ptotal=254 Watts. Thus, in this embodiment, the at least one band of wavelength (input to the monochromator) is included within an X-ray band of wavelengths.

The resulting power density at the first crystal 210 of the CDCM at 35 m is Pdensity=0.88 Watts/$mm^2$ at the incidence angle to the first crystal for monochromator in the X5 beam line. As a point of reference, this is a factor of 6.43 more power density (and hence a factor of 6.43 more flux) than at a X4A bend magnet (1 millirad) used at the existing NYSBC beam line. X4A flux is associated with a total radiant power Ptotal=38 watts, resulting in a power density Pdensity=0.022 watts/$mm^2$ at the incident angle to the first crystal at an X4A monochromator. These power loading parameters are considered for cooling the first crystal in a practical CDCM design.

The salient X-ray beam parameter for analyzing the performance of the illustrated monochromator is the opening angle of the undulator beam in the vertical plane. The diffraction limited opening angle for an undulator with the above parameters is $2\sigma' v$=28 μrad, which when combined with the electron beam divergence results in a full opening angle of $2\sigma' v$=60 μrad. When this opening angle is matched by tangentially bending a Si(111) crystal with a 7° asymmetric cut, an ultimate energy resolution of dE/E=$6.7\times10^{-5}$ is calculated, with 80% optical efficiency. Thus, the band of emitted wavelengths from the second crystal has a width less than about one part in 10000 of a wavelength included in the at least one band of wavelengths. Optical efficiency refers to a ratio of the output energy flux divided by an energy flux in a corresponding band of wavelength in the incident radiation. Thus, the band of emitted wavelengths of the second crystal has an energy flux in amount of at least 50 percent of an energy flux in a corresponding band of wavelength in the incident radiation.

For comparison, a symmetric Si(111) crystal in a typical DCM with flat crystals has an energy resolution dE/E=5.4×

$10^{-4}$ with 48% optical efficiency. This relatively low efficiency is limited by the 60 μrad opening angle. Typically, the energy resolution of a DCM is increased by reducing the opening angle with vertical slits, which further reduces the efficiency below the 48% level. Therefore, to achieve a comparable energy resolution with a DCM would require vertical slitting to a level where the optical efficiency would drop to 3.8%. Thus, in this configuration, the CDCM is superior to the DCM because the CDCM is adapted to select at least one band of wavelengths from diverging incident synchrotron radiation in a given range of wavelengths with an energy resolution finer than about five parts in 10000 and optical efficiency greater than about 50 percent.

Figure 4A:
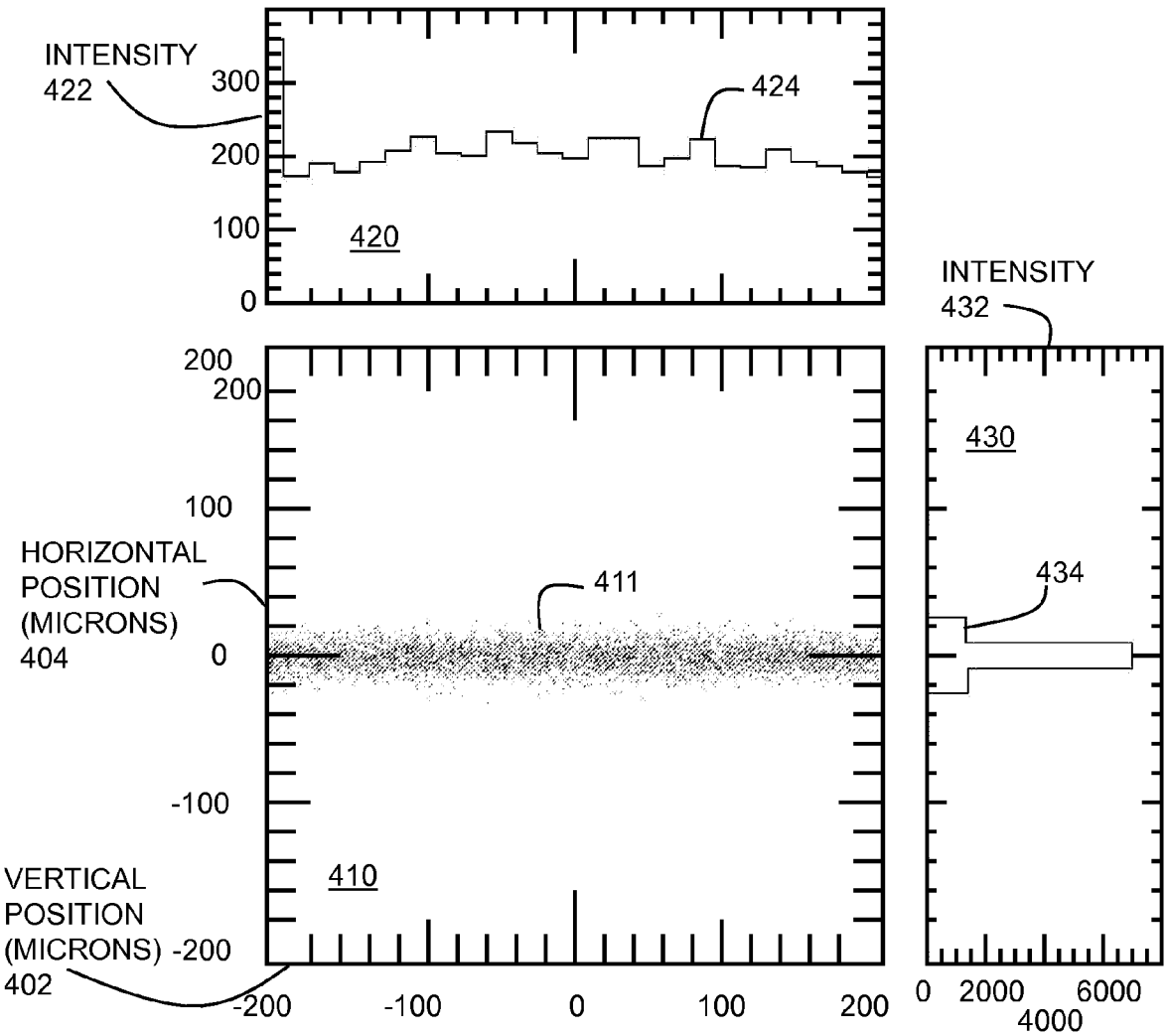
FIG. 4A is a set of graphs that illustrate simulated spatial distribution of photon intensity output by an insertion device at a current synchrotron facility.

The ray tracing results for the above configuration are shown in the scatter plots in FIGS. 4A through 4D. FIG. 4A is a set of graphs 410, 420, 430 that illustrate simulated spatial distribution of photon intensity output by an undulator at the current synchrotron facility (NSLS). The horizontal axis 402 is distance in microns along the vertical direction from a center of the CDCM input port. The vertical axis 404 is distance in microns along the horizontal direction from the center of the CDCM port. Each dot in graph 410 represents a ray trace of the target X-ray wavelength (with energy 12658 eV) from the undulator source arriving at the input port of the CDCM. The source size at the input port is 2σv=640 microns and therefore does not fit into this plot window truncated at 200 microns either side of center. The distribution of dots 411 shows the extended vertical spread compared to the horizontal spread impinging on the first crystal.

The graph 420 sums the dots into bins of 20 micron width centered every 20 microns from the central vertical position at 0 microns. Therefore the axis 402 applies to graph 420. The vertical axis 422 is intensity in arbitrary units for incoming X-rays with the target energy, which depends on the dot count in each vertical distance bin.

The graph 430 sums the dots into bins of 20 micron width centered every 20 microns from the central horizontal position at 0 microns. Therefore the axis 404 applies to graph 430. The horizontal axis 432 is intensity in arbitrary units for incoming X-rays with the target energy, which depends on the dot count in each horizontal distance bin.

As can be seen in FIG. 4A, the target X-ray wavelength is distributed widely in the vertical direction (graph 420) and reasonably well clustered in the horizontal direction (graph 430). For comparison purposes, the same axes 402 and 404 are used for the remaining FIGS. 4B through 4D and 5A through 5D.

Figure 4B:
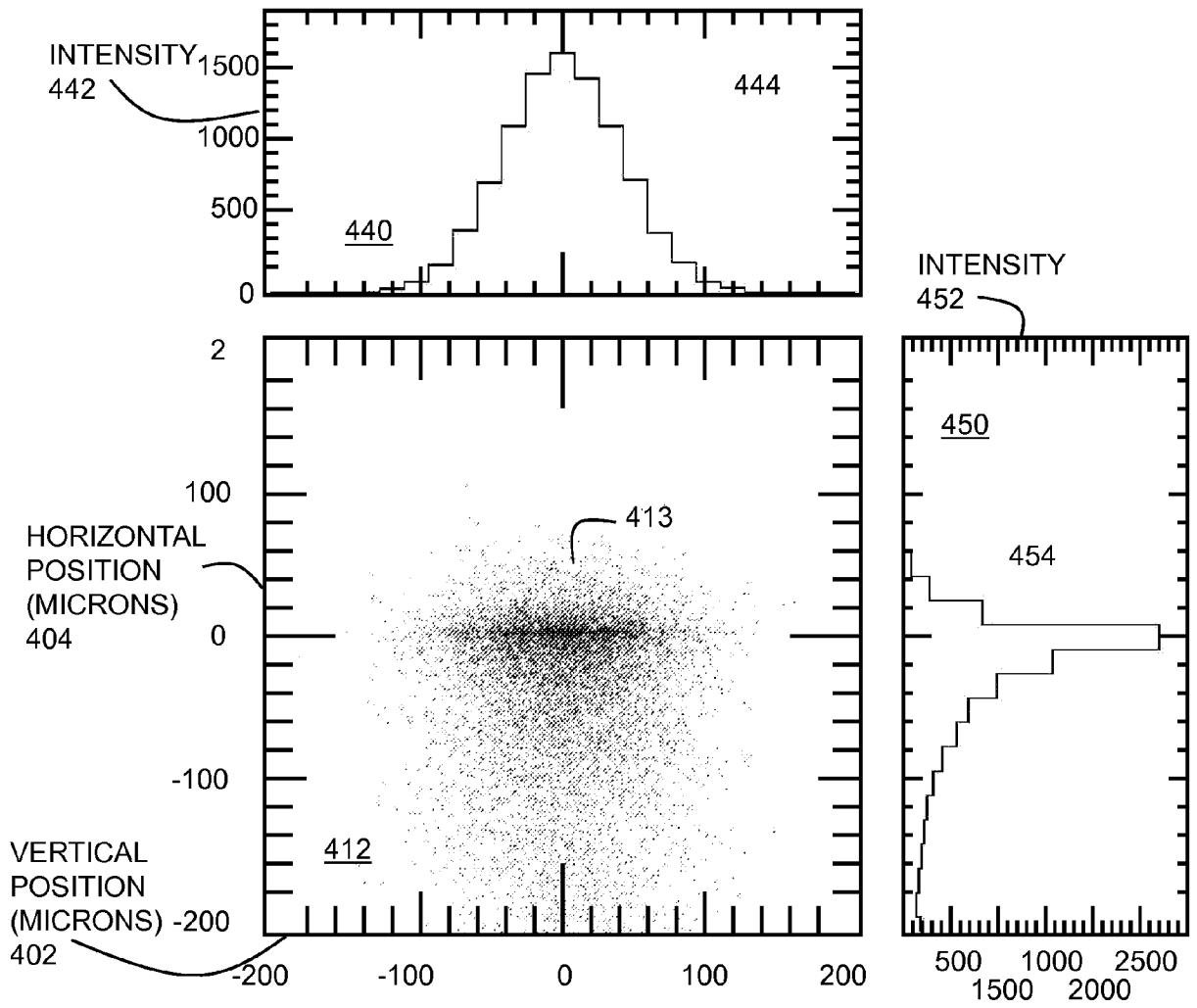
FIG. 4B is a set of graphs that illustrate simulated spatial distribution of photon intensity output by a confocal double crystal monochromator with an input as depicted in FIG. 4A, according to one embodiment.

FIG. 4B is a set of graphs 412, 440, 450 that illustrate simulated spatial distribution of photon intensity output by a confocal double crystal monochromator with an input as depicted in FIG. 4A, according to one embodiment. Each dot in graph 412 represents a ray trace of the target X-ray wavelength (with energy 12658 eV) at the output port of the CDCM including the effect of vertical focusing mirror 230. The distribution of dots 413 shows both vertical and horizontal focusing, as well as an extended vertical spread compared to the horizontal spread.

The graph 440 sums the dots into bins of 20 micron width centered every 20 microns from the central vertical position at 0 microns. The vertical axis 442 is intensity in arbitrary units for output X-rays with the target energy, which depends on the dot count in each vertical distance bin. Substantial vertical focusing is achieved with a roll off within +/−100 microns.

The graph 450 sums the dots into bins of 20 micron width centered every 20 microns from the central horizontal position at 0 microns. The horizontal axis 452 is intensity in arbitrary units for output X-rays with the target energy, which depends on the dot count in each horizontal distance bin. Less horizontal focusing is achieved with a slower asymmetric roll off out to about −100 microns.

It should be noted that 64% of the target X-ray wavelength beam is transferred through a 100 micron square aperture centered at (0,0) in graph 412 which is consistent with the expected sagittal focus. Also worth noting is the maintenance of the originally vertical source dimension in graph 412.

Figure 4C:
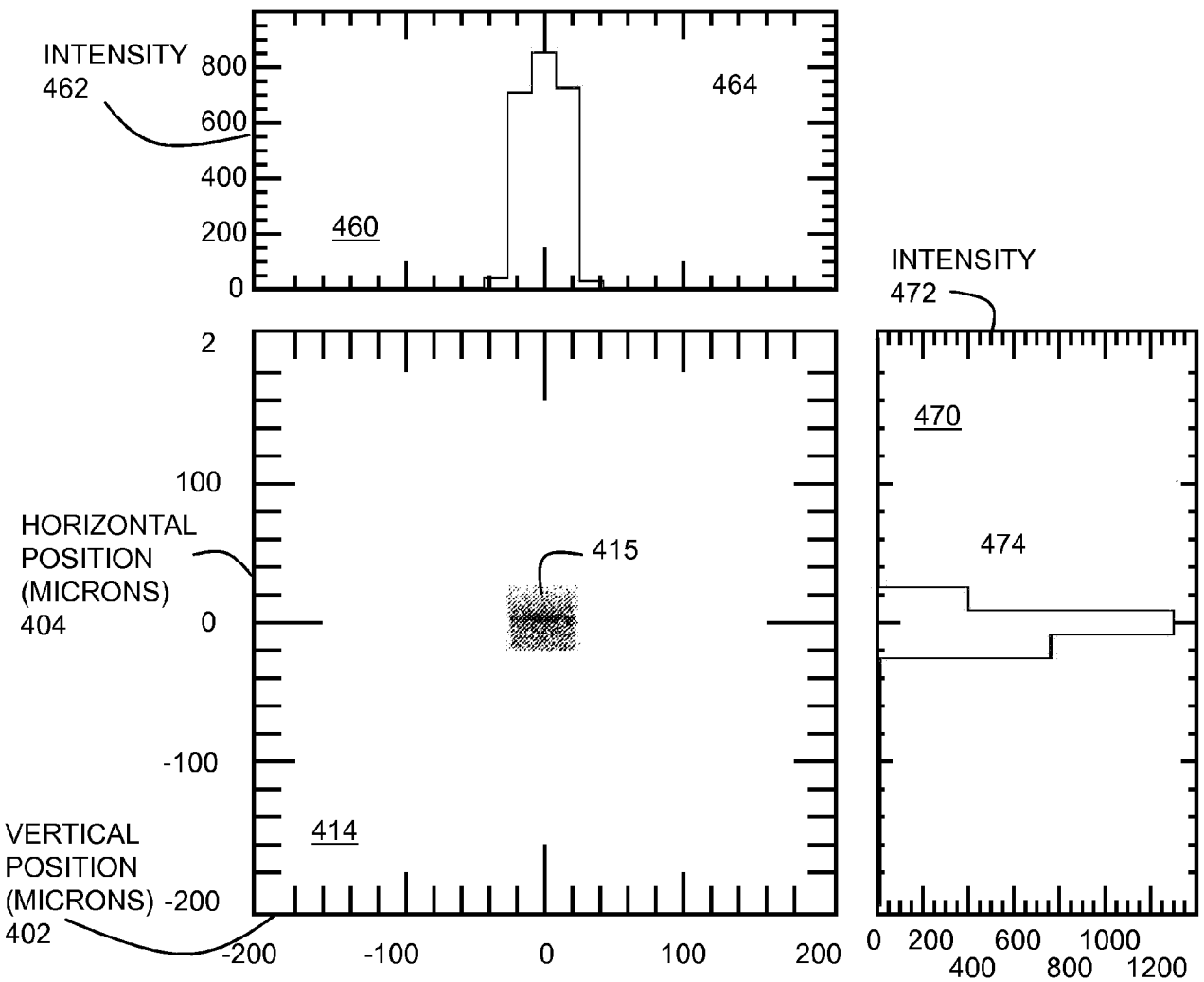
FIG. 4C is a set of graphs that illustrate simulated spatial distribution of photon intensity after output depicted in FIG. 4B is passed through a 50 micron square aperture, according to one embodiment.

FIG. 4C is a set of graphs 414, 460, 470 that illustrate simulated spatial distribution of photon intensity after output depicted in FIG. 4B is passed through a 50 micron square aperture, according to an embodiment. The distribution of dots 415 in graph 414 shows substantially reduced total flux. The graph 460 sums the dots into bins of 20 micron width centered every 20 microns from the central vertical position at 0 microns. The vertical axis 462 is intensity in arbitrary units for output X-rays with the target energy, which depends on the dot count in each vertical distance bin. The graph 470 sums the dots into bins of 20 micron width centered every 20 microns from the central horizontal position at 0 microns. The horizontal axis 472 is intensity in arbitrary units for output X-rays with the target energy, which depends on the dot count in each horizontal distance bin.

Figure 4D:
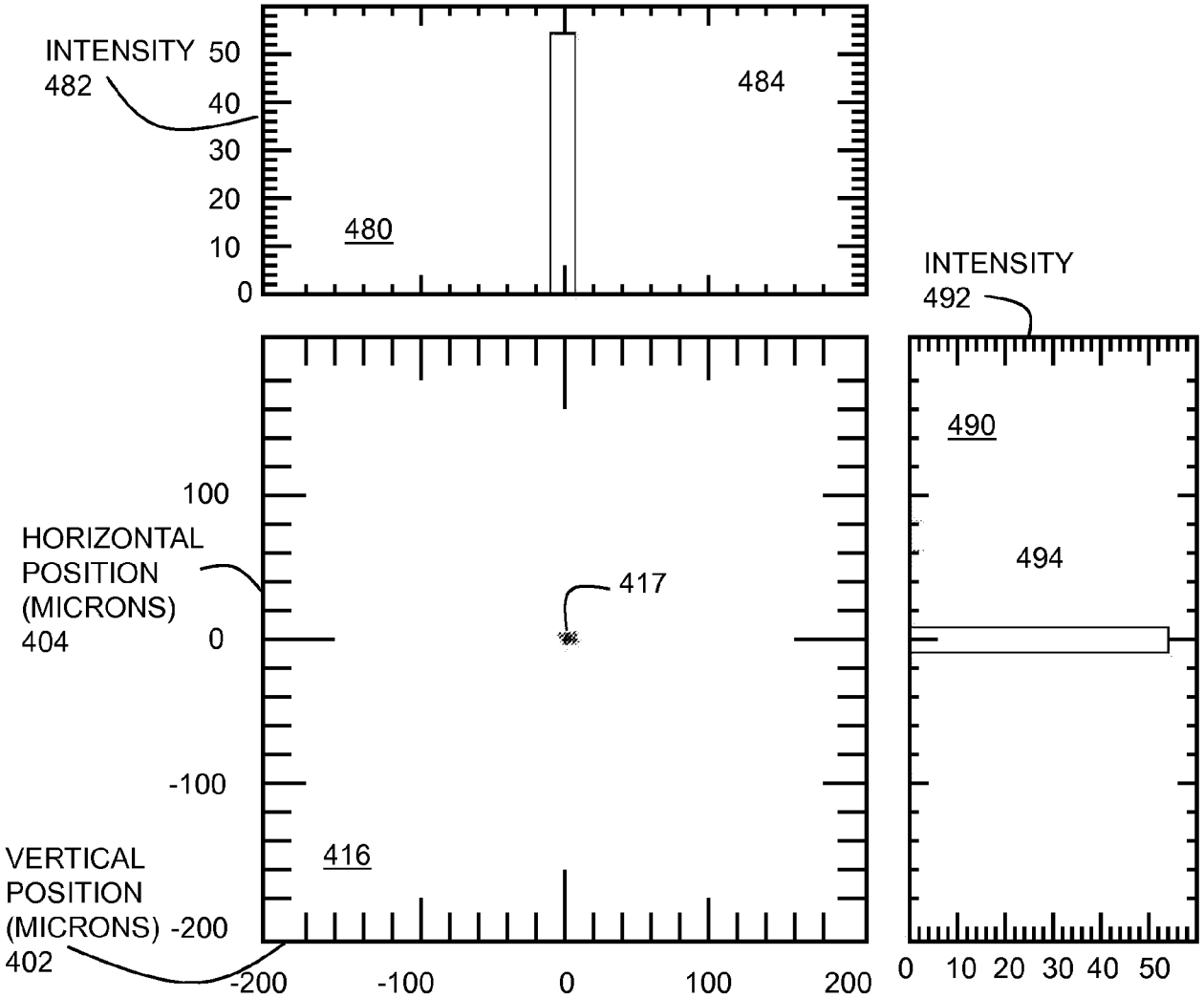
FIG. 4D is a set of graphs that illustrate simulated spatial distribution of photon intensity after output depicted in FIG. 4B is passed through a 5 micron square aperture, according to one embodiment.

FIG. 4D is a set of graphs 416, 480, 490 that illustrate simulated spatial distribution of photon intensity after output depicted in FIG. 4B is passed through a 5 micron square aperture, according to one embodiment. The distribution of dots 417 in graph 416 shows substantially more reduced total flux. The graph 480 sums the dots into bins of 20 micron width centered every 20 microns from the central vertical position at 0 microns. The vertical axis 482 is intensity in arbitrary units for output X-rays with the target energy, which depends on the dot count in each vertical distance bin. The graph 490 sums the dots into bins of 20 micron width centered every 20 microns from the central horizontal position at 0 microns. The horizontal axis 492 is intensity in arbitrary units for output X-rays with the target energy, which depends on the dot count in each horizontal distance bin. Clearly, the use of such small output apertures reduces flux substantially.

The potential performance of the illustrated embodiment of the CDCM at the future NSLSII, given the beam parameters at the proposed low β straight sections, was also ray traced using the SHADOW model. The source size for NSLSII at the low β straight sections is expected to be electron beam widths of 2σv=56 μm, 2σy=5.2 μm along with the following electron beam divergences 2σ'v=3 8 μrad, 2σ'h=6.4 μrad. Assuming these source parameters and keeping all other optical parameters of the model constant, an improvement in producing a micro focus beam with minimal need for defining apertures was demonstrated. Improvement of energy resolution was also demonstrated. Furthermore, the length of the beam line occupied by the CDCM and mirror was also substantially reduced. The results for the NSLSII simulations are seen in the scatter plots shown in FIGS. 5A-5D.

Figure 5A:
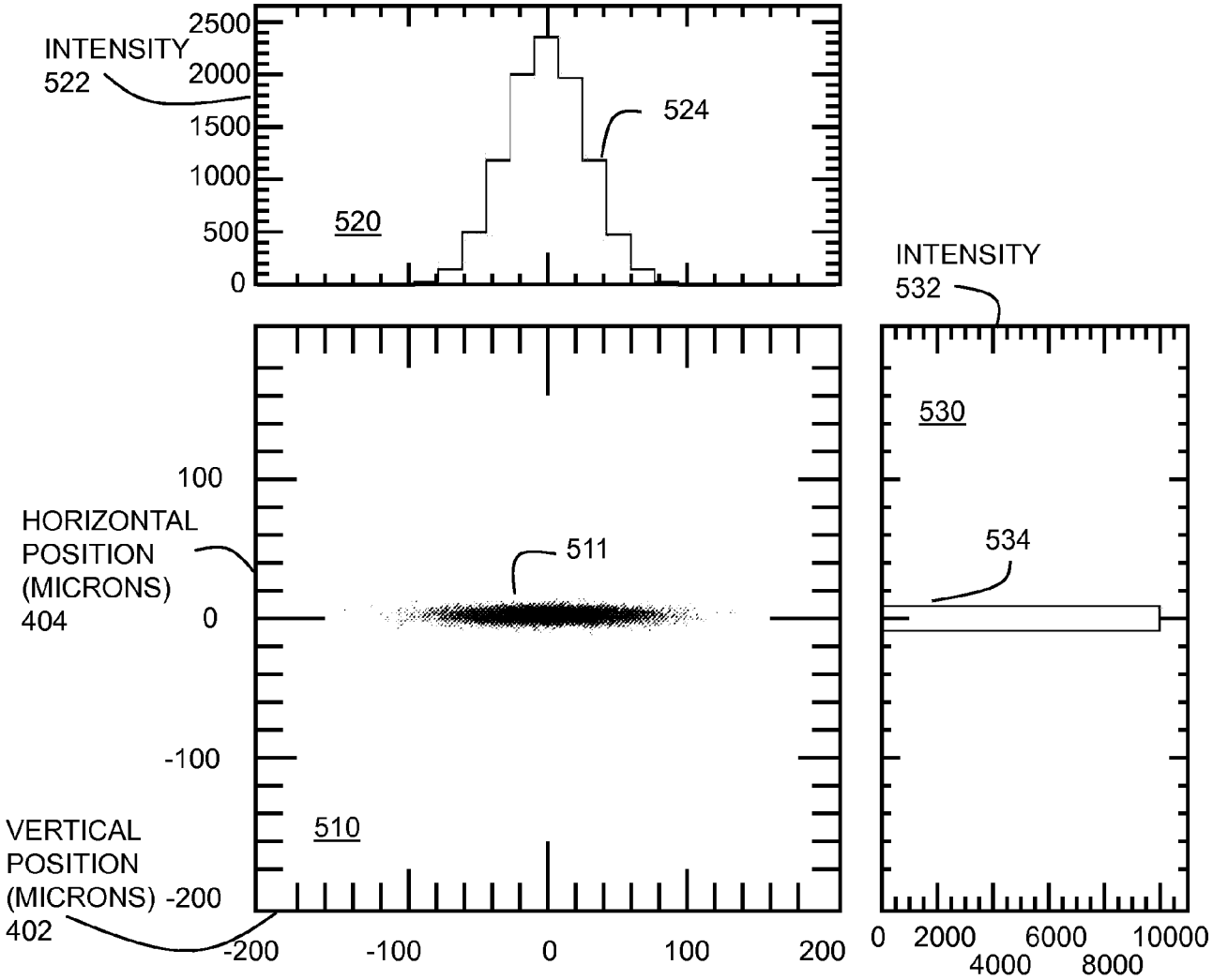
FIG. 5A is a set of graphs that illustrate simulated spatial distribution of photon intensity output by an insertion device at a planned synchrotron facility.

FIG. 5A is a set of graphs 510, 520, 530 that illustrate simulated spatial distribution of photon intensity output by an undulator at the planned synchrotron facility. Each dot in graph 510 represents a ray trace of the target X-ray wavelength (with energy 12658 eV) from the undulator source arriving at the input port of the CDCM. The vertical source size at the input port is about +/−60 microns and therefore fits easily into this plot window truncated at 200 microns either side of center. The distribution of dots 511 shows vastly reduced vertical spread compared to the present synchrotron vertical spread depicted in graph 410, but still exhibits extended vertical spread compared to the horizontal spread impinging on the first crystal.

The graph 520 sums the dots into bins of 20 micron width centered every 20 microns from the central vertical position at 0 microns. The vertical axis 422 is intensity in arbitrary units for incoming X-rays with the target energy, which depends on the dot count in each vertical distance bin. The graph 530 sums the dots into bins of 20 micron width centered every 20 microns from the central horizontal position at 0 microns. The horizontal axis 432 is intensity in arbitrary units for incoming X-rays with the target energy, which depends on the dot count in each horizontal distance bin.

As can be seen in FIG. 5A, the target X-ray wavelength is better focused in the vertical direction (graph 520) and the horizontal direction (graph 530) than in those directions for the present synchrotron, as depicted in graphs 420 and 430, respectively. For NSLSII, the peak intensity in the vertical plane rolls off within about +/−60 microns. The peak intensity in the horizontal plane rolls off within about +/−10 microns.

Figure 5B:
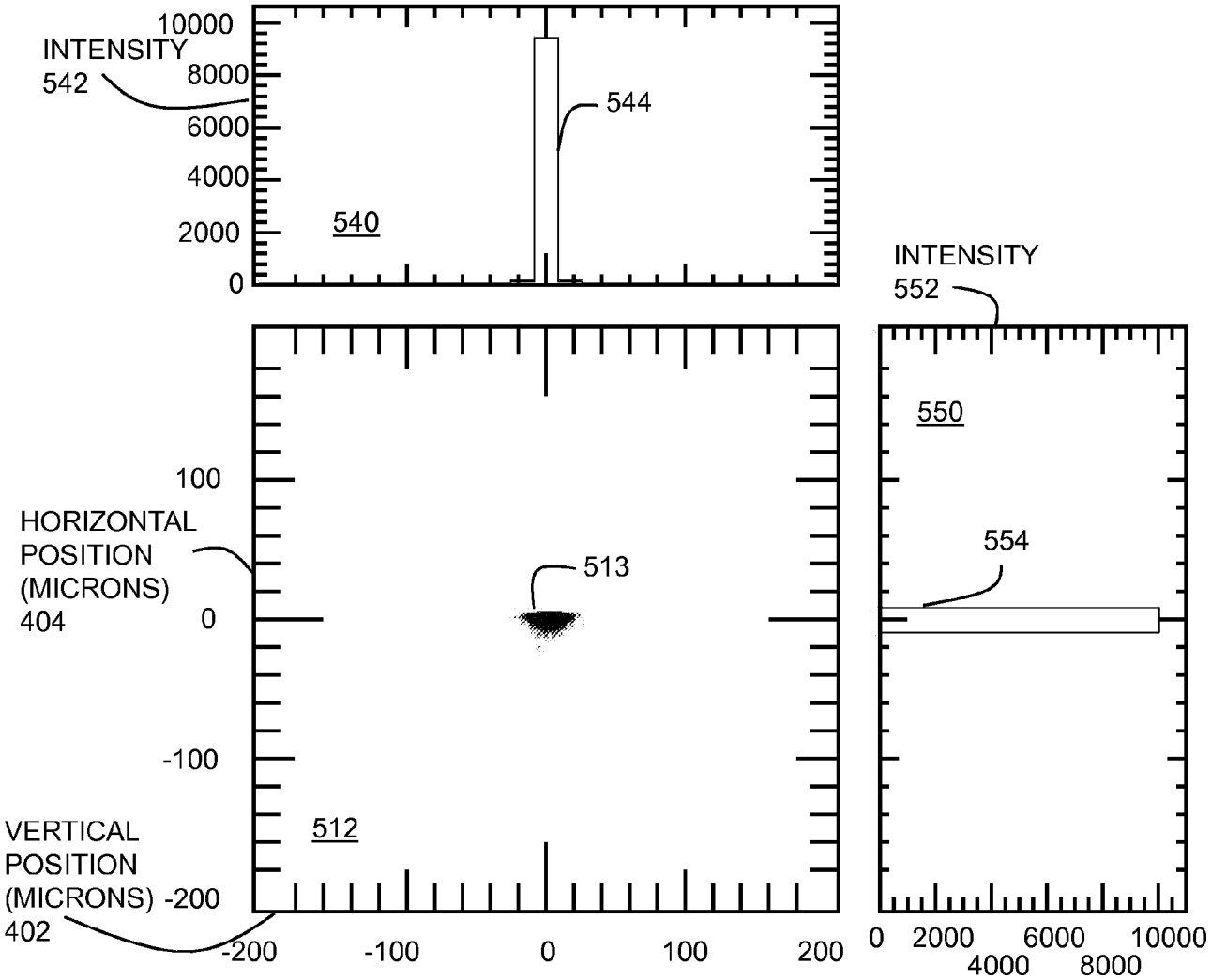
FIG. 5B is a set of graphs that illustrate simulated spatial distribution of photon intensity output by a confocal double crystal monochromator with an input as depicted in FIG. 5A, according to an embodiment, according to one embodiment.

FIG. 5B is a set of graphs 512, 540, 550 that illustrate simulated spatial distribution of photon intensity output by a confocal double crystal monochromator with an input as depicted in FIG. 5A, according to an embodiment. Each dot in graph 512 represents a ray trace of the target X-ray wavelength (with energy 12658 eV) at the output port of the CDCM including the effect of vertical focusing mirror 230. The distribution of dots 513 shows both vertical and horizontal focusing, as well as similar vertical and horizontal spreads on the order of +/−10 microns.

The graph 540 sums the dots into bins of 20 micron width centered every 20 microns from the central vertical position at 0 microns. The vertical axis 542 is intensity in arbitrary units for output X-rays with the target energy, which depends on the dot count in each vertical distance bin. Substantial vertical focusing is achieved with a roll off within +/−10 microns, about six times faster than the roll off of +/−60 microns in graph 520.

The graph 550 sums the dots into bins of 20 micron width centered every 20 microns from the central horizontal position at 0 microns. The horizontal axis 552 is intensity in arbitrary units for output X-rays with the target energy, which depends on the dot count in each horizontal distance bin. Horizontal focusing is similar to the input, with a roll off out to about +/−10 microns.

FIG. 5A and FIG. 5B thus show that higher energy resolution and better focusing is achieved in shorter distances than in the current synchrotron. The optical efficiency is improved to 94% due to the reduction in the opening angle as well as imaging a true micro-focus beam to less than about 50 μm at input to the monochromator. It is worth noting that, even at the greatly reduced angular phase-space, optical efficiency would be reduced to 76% without bending the first crystal, due to the vertical spread at a single wavelength.

Figure 5C:
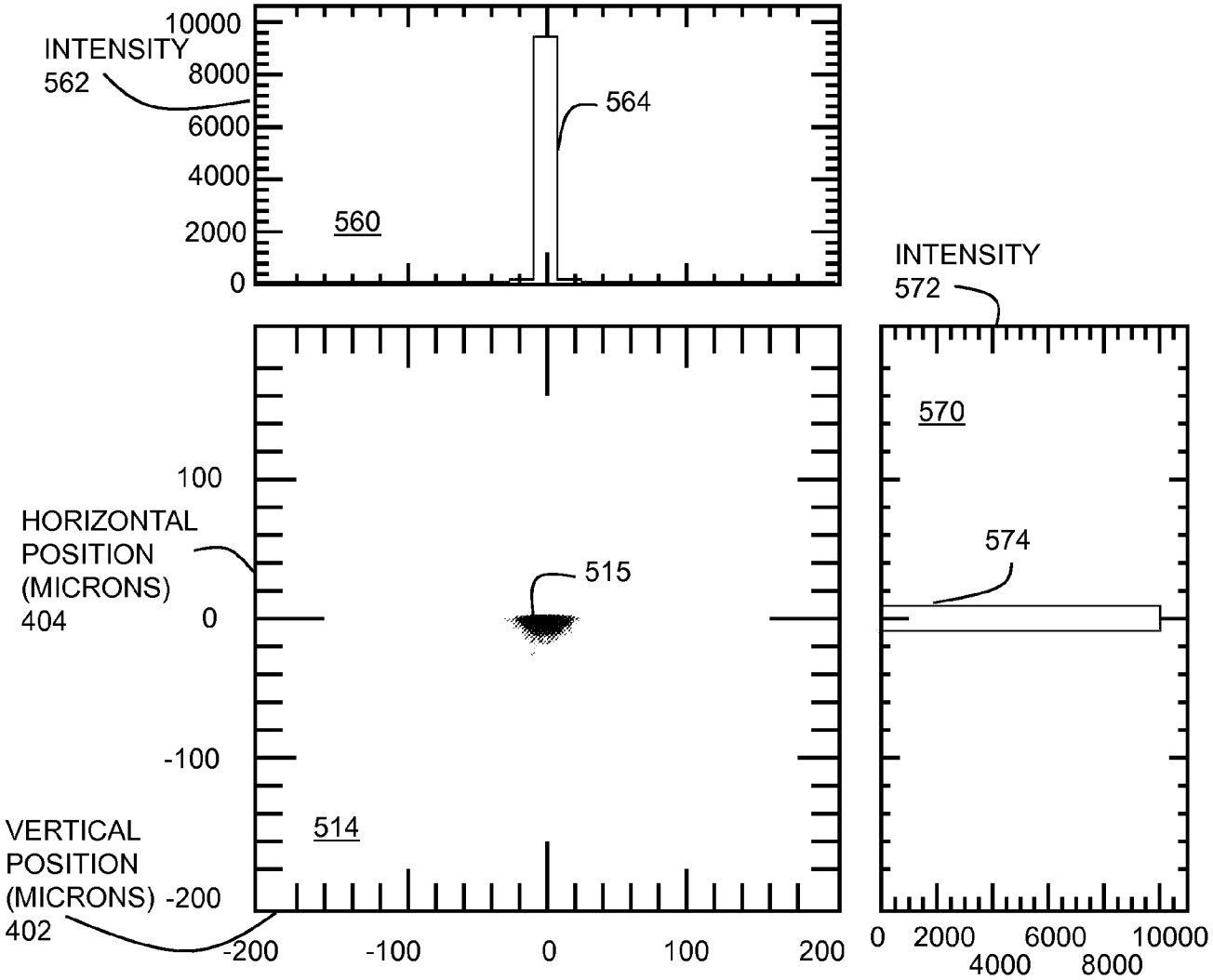
FIG. 5C is a set of graphs that illustrate simulated spatial distribution of photon intensity after output depicted in FIG. 5B is passed through a 50 micron square aperture, according to one embodiment.

FIG. 5C is a set of graphs 514, 560, 570 that illustrate simulated spatial distribution of photon intensity after output depicted in FIG. 5B is passed through a 50 micron square aperture, according to one embodiment. The distribution of dots 515 in graph 514 shows substantially the same total flux. The graph 560 sums the dots into bins of 20 micron width centered every 20 microns from the central vertical position at 0 microns. The vertical axis 562 is intensity in arbitrary units for output X-rays with the target energy, which depends on the dot count in each vertical distance bin. The graph 570 sums the dots into bins of 20 micron width centered every 20 microns from the central horizontal position at 0 microns. The horizontal axis 572 is intensity in arbitrary units for output X-rays with the target energy, which depends on the dot count in each horizontal distance bin. FIG. 5C shows that substantively 100% of the focused beam output by the CDCM is transferred through a 50 micron square aperture.

Figure 5D:
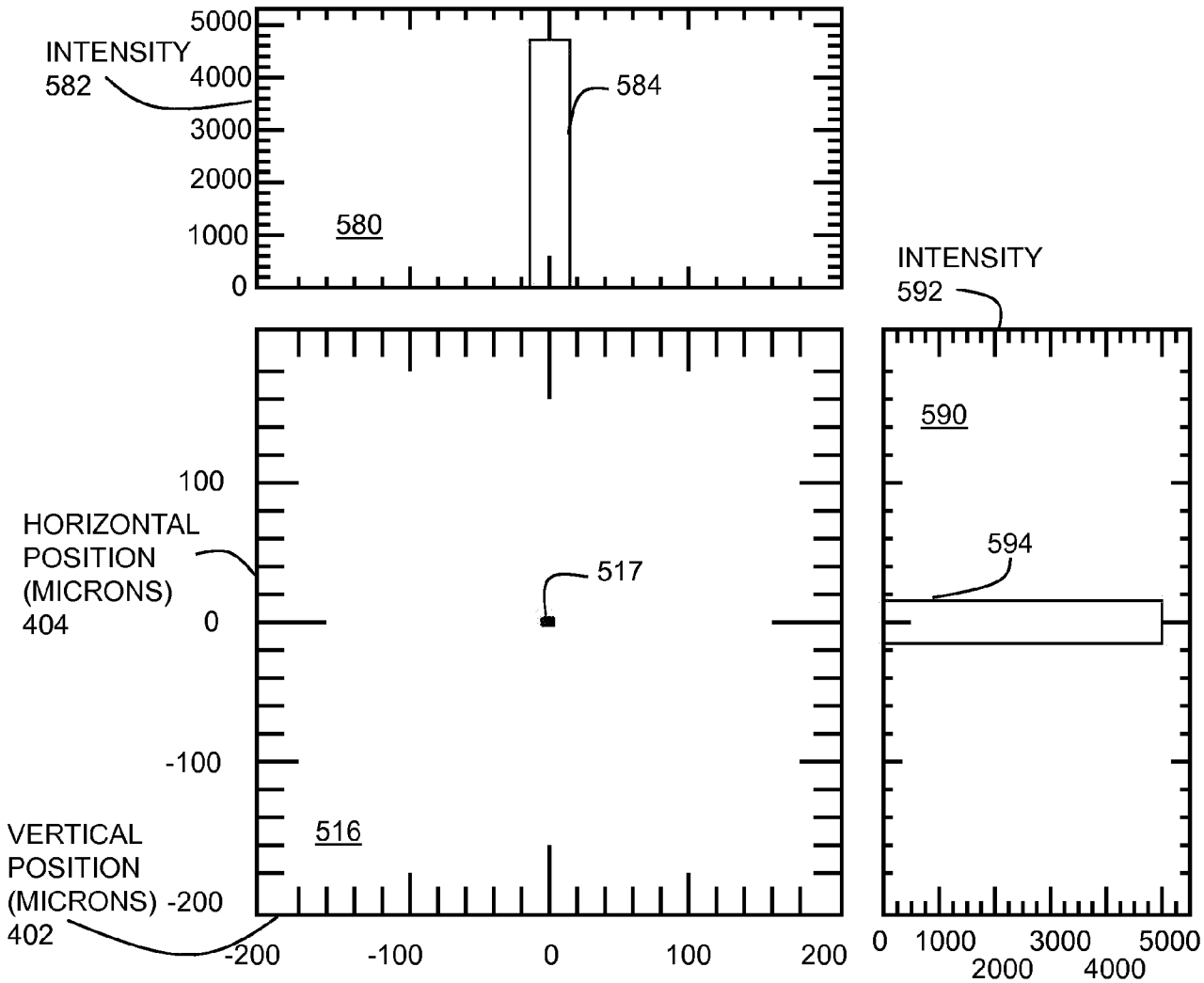
FIG. 5D is a set of graphs that illustrate simulated spatial distribution of photon intensity after output depicted in FIG. 5B is passed through a 5 micron square aperture, according to one embodiment.

FIG. 5D is a set of graphs 516, 580, 590 that illustrate simulated spatial distribution of photon intensity after output depicted in FIG. 5B is passed through a 5 micron square aperture, according to one embodiment. The distribution of dots 517 in graph 516 shows heavily reduced total flux. The graph 580 sums the dots into bins of 20 micron width centered every 20 microns from the central vertical position at 0 microns. The vertical axis 582 is intensity in arbitrary units for output X-rays with the target energy, which depends on the dot count in each vertical distance bin. The graph 590 sums the dots into bins of 20 micron width centered every 20 microns from the central horizontal position at 0 microns. The horizontal axis 592 is intensity in arbitrary units for output X-rays with the target energy, which depends on the dot count in each horizontal distance bin. Clearly, the use of such small output apertures reduces flux substantially.

As can be seen from the above ray tracing simulation, the overall beam line performance is markedly improved due to the decreased phase-space associated with the future NSLSII at the undulator. The beam line simulation also clearly demonstrates that the CDCM geometry optimizes performance and simplifies the overall optical system by reducing the total number of optics (e.g., eliminating collimating mirrors and additional apertures) in a beam line design, and improves efficiency for narrow energy resolution, for both present and future synchrotrons.

In the foregoing specification, the invention has been described with reference to specific embodiments thereof. It will, however, be evident that various modifications and changes may be made thereto without departing from the broader spirit and scope of the invention. The specification and drawings are, accordingly, to be regarded in an illustrative rather than a restrictive sense.

What is claimed is:

1. An apparatus adapted to select at least one band of wavelengths from diverging incident synchrotron x-ray radiation in a given range of wavelengths with an energy resolution in a range from about 0.5 parts in 10000 to about five parts in 10000 and optical efficiency in a range from about 50 percent to about 90 percent.

2. An apparatus comprising:

a first crystal adjustably oriented relative to diverging incident synchrotron x-ray radiation wherein a band of emitted wavelengths of the first crystal includes at least one band of wavelengths narrower than a range of wavelengths of the incident synchrotron x-ray radiation, and a surface curvature of the first crystal is adapted to focus emitted radiation in a first plane;

a second crystal adjustably oriented relative to radiation emitted from the first crystal wherein a band of emitted wavelengths of the second crystal includes the at least one band of wavelengths, and the second crystal is asymmetrically cut whereby parallel faces of a lattice structure of the second crystal are oriented at a first predetermined angle from a surface of the second crystal; and an aperture disposed to block radiation emitted from the second crystal having wavelengths outside the at least one band of wavelengths.

3. An apparatus as recited in claim 2, wherein the second crystal is disposed to receive at least the band of emitted wavelengths of the first crystal.

4. An apparatus as recited in claim 3, wherein the second crystal is adapted to rotate so that radiation emitted by the second crystal is directed in a similar direction and spatially offset from the incident synchrotron x-ray radiation.

5. An apparatus as recited in claim 2, wherein the first crystal is asymmetrically cut whereby parallel faces of a lattice structure of the first crystal are oriented at a second predetermined angle from a surface of the first crystal.

6. An apparatus as recited in claim 5, wherein the second predetermined angle is about seven degrees.

7. An apparatus as recited in claim 5, wherein a surface curvature of the second crystal is adapted to focus emitted radiation in a second plane perpendicular to the first plane.

8. An apparatus as recited in claim 7, wherein the first predetermined angle is oriented so that a band of emitted wavelengths of the first crystal has a width in a range from about 0.5 parts in 10000 to about five parts in 10000 of a wavelength included in the at least one band of wavelengths.

9. An apparatus as recited in claim 7, further comprising a mirror with a curved surface adapted to position a vertical focus of radiation emitted from the second crystal in the band of emitted wavelengths of the second crystal.

10. An apparatus as recited in claim 2, wherein the band of emitted wavelengths of the second crystal has a width in a range from about 0.5 parts in 10000 to about five parts in 10000 of a wavelength included in the at least one band of wavelengths.

11. An apparatus as recited in claim 2, wherein the band of emitted wavelengths of the second crystal has an energy flux in a range from about 50 percent to about 90 percent of an energy flux in a corresponding band of wavelength in the incident radiation.

12. An apparatus as recited in claim 2, further comprising a mirror with a curved surface adapted to reject high order harmonics of at least one of the band of emitted wavelengths of the first crystal or the band of emitted wavelengths of the second crystal.

* * * * *